US006220912B1

(12) United States Patent
Shigeoka et al.

(10) Patent No.: US 6,220,912 B1
(45) Date of Patent: Apr. 24, 2001

(54) METHOD AND APPARATUS FOR PRODUCING ELECTRON SOURCE USING DISPENSER TO PRODUCE ELECTRON EMITTING PORTIONS

(75) Inventors: Kazuya Shigeoka, Tokyo; Mitsutoshi Hasegawa, Yokohama; Seiji Mishima, Zama; Kazuhiro Sando, Atsugi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/074,698

(22) Filed: May 8, 1998

(30) Foreign Application Priority Data

May 9, 1997 (JP) ..... 9-134465

(51) Int. Cl.[7] ..... H01J 9/02
(52) U.S. Cl. ..... 445/24; 445/51
(58) Field of Search ..... 445/24, 46, 49, 445/50, 51

(56) References Cited

U.S. PATENT DOCUMENTS 6,017,259 * 1/2000 Motoi et al. ..... 445/51

FOREIGN PATENT DOCUMENTS 2-56822 2/1990 (JP) .
8-171850 7/1996 (JP) .

OTHER PUBLICATIONS

H. Araki, et al., *Electroforming and Electron Emission of Carbon Thin Films*, Journal of the Vacuum Society of Japan, vol. 26, No. 1, pp. 22–29, (Sep., 1956).

G. Dittmer, *Electrical Conduction and Electron Emission of Discontinuous Thin Films*, Thin Solid Films, vol. 9, pp. 317–328, (1972).

M. Hartwell, et al., *Strong Electron Emission from Patterned Tin–Indium Oxide Thin Films*, International Electron Devices Meeting, pp. 519–521, (1975).

M. L. Elinson, et al., *The Emission of Hot Electrons and the Field Emission of Electrons from Tin Oxide*, Radio Engineering and Electronic Physics, pp. 1290–1296, (Jul., 1965).

C. A. Mead, *Operation of Tunnel–Emission Devices*, Journal of Applied Physics, vol. 32, No. 4, (Apr., 1961).

C. A. Spindt, et al., *Physical Properties of Thin–Film Field Emission Cathodes with Molybdenum Cones*, Journal of Applied Physical, vol. 47, No. 12, (Dec. 1976).

W. P. Dyke, et al., *Field Emission*, Advances in Electronics and Electron Physics, vol. 8, pp. 89–185, (1956).

* cited by examiner

*Primary Examiner*—Nimeshkumar D. Patel
*Assistant Examiner*—Joseph Williams
(74) *Attorney, Agent, or Firm*—Fitzpatrick, Cella, Harper & Scinto

(57) ABSTRACT

In order to suppress variation in delivery amounts in dispensing a material for forming electron emitting portions, a substantially homogeneous material is dispensed from a plurality of output portions to each of plural objective portions. This averages amounts of the material dispensed to the respective objective portions even if there is variation in delivery amounts of material from the respective output portions.

18 Claims, 15 Drawing Sheets

METHOD AND APPARATUS FOR PRODUCING ELECTRON SOURCE USING DISPENSER TO PRODUCE ELECTRON EMITTING PORTIONS

BACKGROUND OF THE INVENTION

1. Field of the Invention

The present invention relates to a method for producing an electron source having electron emitting portions. The present invention also relates to an electron source produced by the producing method thereof, an image forming apparatus using the electron source, and an apparatus for producing the electron source.

2. Related Background Art

The electron emitting elements conventionally known are roughly classified under two types using thermionic emission elements and cold emission elements. Examples of the cold emission elements are electron emitting elements of a field emission type (hereinafter referred to as "FE type"), a metal/insulator/metal type (hereinafter referred to as "MIM type"), a surface conduction type, and so on. Examples of the FE type known are those disclosed in W. P. Dyke & W. W. Doran, "Field Emission," Advance in Electron Physics, 8, 89 (1956), C. A. Spindt, "Physical Properties of thin-film field emission cathodes with molybdenum cones," J. Appl. Phys., 47, 5248 (1976), and so on. An example of the MIM type known is the one as disclosed in C. A. Mead, "Operation of Tunnel-Emission Devices," J. Appl. Phys., 32, 646 (1961), for example.

An example of the surface conduction type electron emitting element is the one as disclosed in M. I. Elinson, Radio Eng. Electron Phys., 10, 1290 (1965), for example.

The surface conduction type electron emitting element emits electrons when a current is allowed to flow in parallel to the film plane through a thin film of a small area formed on a substrate. There are reports on this surface conduction type electron emitting element; for example, those using Au thin film [G. Dittmer: Thin Solid Films, 9, 317 (1972)], using $In_2O_3/SnO_2$ thin film [M. Hartwell and C. G. Fonstad: IEEE Trans. ED Conf., 519 (1975)], using carbon thin film [Hisashi Araki et al.: Vacuum, Vol 26, No. 1, p 22 (1983)], and so on.

FIG. 16 schematically shows the element configuration of M. Hartwell, as described above, as a typical example of these surface conduction type electron emitting elements. In the same figure reference numeral 1 designates a substrate. Numeral 4 represents a conductive thin film, which is, for example, a thin film of metal oxide formed in a pattern of H-shape by sputtering. An electron emitting section 5 is formed by an electrification process called "energization forming" as detailed hereinafter. The distance L1 between the element electrodes in the drawing is set to 0.5 to 1 mm and the width W' to 0.1 mm. Since the position and shape of the electron emitting section 5 are not described specifically, the element is illustrated as a schematic view.

In these conventional surface conduction type electron emitting elements, the electron emitting section 5 is formed generally by preliminarily subjecting the conductive thin film 4 to the electrification process called the energization forming prior to emission of electron. The energization forming is formation of the electron emitting section by electrification, which is achieved, for example, by applying a do voltage or very slowly increasing voltages to the both ends of the conductive thin film 4 to effect electrification, so as to locally break, deform, or alter the conductive thin film, thereby forming the electron emitting section 5 kept in an electrically high resistance state. The electron emitting section 5 has a crack produced in a part of the conductive thin film 4 and emits electrons from near the crack. The surface conduction type electron emitting element processed by the aforementioned energization forming process emits electrons from the above-stated electron emitting section 5 when the voltage is applied to the conductive thin film 4 to allow the current to flow through the element.

The surface conduction type electron emitting elements described above have the advantage that a lot of surface conduction type emitting elements can be arrayed over a large area, because the structure is simple and they can be produced using the conventional semiconductor fabrication technology. There are researches on such various applications as to make use of this feature. Examples of the applications are image forming apparatus such as charged electron beam sources and display devices.

FIG. 15 shows the structure of the electron emitting element disclosed in the official gazette of Japanese Laid-open Patent Application No. 2-56822 filed by Applicant. In the same figure, numeral 1 denotes a substrate, 2 and 3 element electrodes, 4 a conductive thin film, and 5 an electron emitting section. There are a variety of methods for producing this electron emitting element. For example, the element electrodes 2 and 3 are formed on the substrate 1 by the vacuum thin film technology and photolithography etching technology in the ordinary semiconductor processes. Then the conductive thin film 4 is formed by a dispersion coating method such as spin coating, or the like. After that, the voltage is applied to the element electrodes 2, 3 to carry out the electrification process, thereby forming the electron emitting section 5.

This production method in the conventional example has drawbacks that large-scale photolithography etching facilities are necessary and indispensable for forming the elements over a large area, the number of steps is also large, and the production cost is thus high. In view of these drawbacks, there are proposals on methods for forming the conductive thin film of the surface conduction type electron emitting element by directly dispensing droplets of a solution containing a metal element for the conductive thin film by the ink jet method (for example, as disclosed in Japanese Laid-open Patent Application No. 8-171850).

Since the conventional ink jet method as described in the official gazette of Japanese Laid-open Patent Application No. 8-171850 etc. is a method for dispensing a droplet 7 from a droplet dispensing device 6 having a single nozzle as shown in FIGS. 14A, 14B, and 14C. there is the limit of increase in throughput in the case where a plurality of droplets have to be dispensed to each element, however.

The present invention provides a method for producing an electron source by adopting a novel method for dispensing the material for formation of the electron emitting section.

SUMMARY OF THE INVENTION

An aspect of the invention is a method for producing an electron source as described below.

The production method of electron source is a method for producing an electron source having a plurality of electron emitting portions, said method comprising a step of:

by use of a plurality of output portions for respectively outputting a substantially homogeneous material for formation of said electron emitting portions, performing at least one dispensing operation of said material from each of the output portions to each of plural objective portions to which the material for formation of said electron emitting portions is to be dispensed.

This method suppresses the variation in the material dispensed to the respective objective portions even with the structure using the plural output portions and, particularly, it suppresses the variation in amounts of the material dispensed.

In the above method of the invention, it is preferred that each of said objective portions be subjected to an identical combination of dispensing operations of the material from said plural output portions. Here, the identical combination is that each objective portion undergoes the same number of dispensing operations of the material by the plurality of output portions and thus the numbers of dispensing operations from each output portion are identical among the objective portions. For example, in the case of two output portions being used, dispensing of the material from one output portion is carried out p ($\geqq 1$) times for each objective portion, dispensing of the material from the other output portion is carried out q ($\geqq 1$) times for each objective portion, and each objective portion experiences the same number (p+q) of dispensing operations of the material. This can suppress the dispersion in dispensing of material from the plural output portions particularly well.

In either case of the invention as described above, it is preferred that dispensing operations of the material from the different output portions be carried out substantially simultaneously to the different objective portions. Here, "be carried out substantially simultaneously" is substantiated, for example, by the structure in which the relative positions of the output portions and the objective portions are changed and, during a period prior to next change of the relative positions, dispensing operations of the material from the different output portions are carried out for the different objective portions, respectively. This method can further increase the throughput in the present invention for carrying out plural dispensing operations of the material to one objective portion.

Another aspect of the present invention is a method for producing an electron source, as described below.

Another method is a method for producing an electron source having a plurality of electron emitting portions arranged in a column shape, said electron emitting portions being formed by dispensing a material to objective portions arranged in said column shape, said method comprising a step of:

with moving a material dispensing device having a plurality of output portions arranged in a column direction in correspondence to intervals of the objective portions in the column direction (for example, the output portions being arranged at intervals equal to those of the objective portions) relative to said objective portions at said intervals of the objective portions in the column direction, performing dispensing operations of a substantially homogeneous material from said plurality of output portions to said respective objective portions.

This producing method may also be used in the above-stated producing methods.

In this method of the invention, the number of dispensing operations of the material to one objective portion is preferably not less than the number of the output portions.

The above method of the invention may also be adapted in such manner that said electron source has a plurality of electron emitting portions arranged in a row and column pattern, a row direction is not parallel to said column direction, the dispensing operations of said material to said respective objective portions are carried out while moving said material dispensing device relative to said objective portions in said row direction, wherein the column and the row correspond to the column and the row in the embodiment disclosed in the following description merely, and may correspond respectively row and column in another example.

The above method of the invention may also be adapted in such manner that every time relative positions of said material dispensing device and said objective portions are changed in said column direction, dispensing operations of said material are carried out with successively moving said material dispensing device in said row direction, thereby performing the dispensing operations of the material to said respective objective portions arranged in the row direction.

In either of the methods of the present invention, the dispensing operation of said material can be carried out in a liquid state of said material. The output portions can be nozzles. The dispensing operation of the material in the liquid state can be performed by discharging droplets of the material.

In each of the above methods of the invention, the dispensing operation of said material can be carried out by an ink jet method.

In each of the above methods of the invention, the dispensing operation of said material is carried out by a method for generating a bubble in said material by use of thermal energy and discharging said material, based on generation of the bubble; or the dispensing operation of said material is carried out by discharging said material by means of a piezoelectric device.

In each of the above methods of the present invention, each of said electron emitting portions is formed between element electrodes. For example, each of the electron emitting portions is formed between a pair of element electrodes.

In each of the above methods of the invention, the electron emitting portions are formed by further processing the material deposited on the objective portions. The processing is, for example, electrification. The processing may also be so-called forming or activation.

In each of the above methods of the invention, said material contains an electrically conductive material.

The present invention involves an electron source produced by either one of the methods for producing the electron source according to the above-described aspects of the invention; a method for producing an image forming apparatus, said method comprising a step of placing a member for forming an image with electrons emitted from the electron emitting portions of said electron source, opposite the electron source; and an image forming apparatus produced by the method for producing it.

Another aspect of the invention is an apparatus for producing an electron source, as described below.

The apparatus is an apparatus for producing an electron source having a plurality of electron emitting portions, said apparatus comprising:

a plurality of output portions for respectively outputting a substantially homogeneous material for formation of said electron emitting portions; and controlling means for controlling outputting of said material from the output portions in such manner as to perform at least one dispensing operation of said material from each of said output portions to each of plural objective portions to which the material for forming said electron emitting portions is to be dispensed.

Here, the controlling means may have means for moving said output portions relative to said objective portions.

Another aspect of the invention is an apparatus for producing an electron source, as described below.

The apparatus is a production apparatus of electron source for producing an electron source having a plurality of electron emitting portions arranged in a column shape, said electron emitting portions being formed by dispensing a material to objective portions arranged in said column shape, said production apparatus comprising:

a material dispensing device having a plurality of output portions arranged in a column direction in correspondence to intervals of the objective portions in the column direction; and moving means for moving said material dispensing device relative to said objective portions at the intervals of said objective portions in the column direction;

wherein a substantially homogeneous material is dispensed from said plurality of output portions to the respective objective portions while moving said material dispensing device relative to said objective portions by said moving means.

Here, the apparatus may be arranged in such manner that said electron source has a plurality of electron emitting portions arranged in a row and column pattern, a row direction is not parallel to said column direction, and said moving means is one capable of also moving said material dispensing device relative to said objective portions in said row direction.

The material is dispensed in parallel from the respective output portions to plural rows, whereby dispensing of material can be performed within a short time. When this dispensing of material in the row direction is repeated with successively moving the string of output portions in the column direction (at the pitch of one column), each objective portion receives the material from the different output portions in order with the movement of the string of output portions in the column direction. It can suppress the variation in delivery amounts of the material even if the delivery amounts of the material from the respective output portions are different from each other.

DETAILED DESCRIPTION OF THE PREFERRED EMBODIMENTS

The preferred embodiments of the present invention will be described below.

Figure 5A:
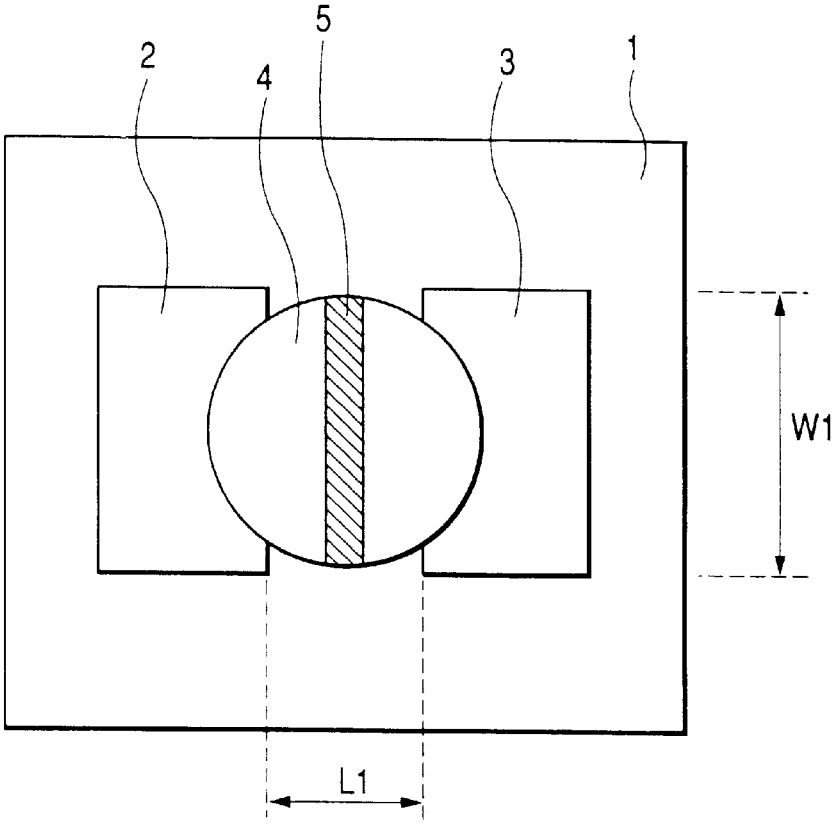
FIG. 5A and FIG. 5B are a schematic plan view and a sectional view to show the structure of a surface conduction type electron emitting element of a flat type as an embodiment of the present invention.
Figure 5B:
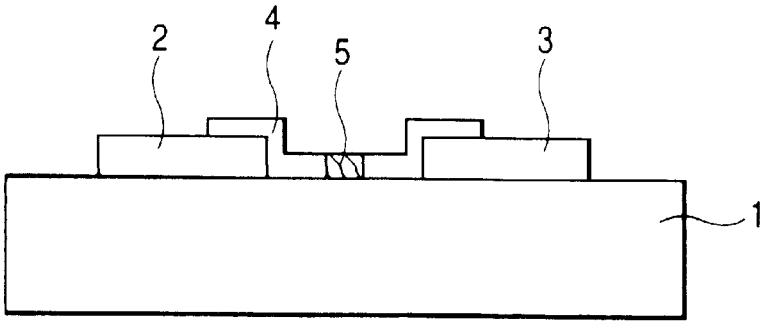

FIGS. 5A and 5B are schematic views to show the structure of a surface conduction type electron emitting element according to an embodiment of the present invention, wherein FIG. 5A is a plan view and FIG. 5B is a sectional view. In FIGS. 5A and 5B reference numeral 1 designates a substrate, 2 and 3 element electrodes, 4 an electroconductive thin film, and 5 an electron emitting section.

The substrate 1 can be either one selected from quartz glass, glass with a reduced content of an impurity such as Na, blue sheet glass, a glass substrate on the surface of which $SiO_2$ is deposited, a substrate of a ceramic material such as alumina, and so on.

The material for the opposed element electrodes 2, 3 may be selected from a variety of conductive materials; e.g., printed conductors comprised of metal or alloy of Ni, Cr, Au, Mo, W, Pt, Ti, Al, Cu, Pd, or the like and metal or metal oxide of Pd, As, Ag, Au, $RuO_2$, Pd—Ag, or the like with glass or the like, transparent conductors such as $In_2O_3$—$SnO_2$, and semiconductor/conductor materials such as polysilicon, and so on.

The distance L1 between the element electrodes, the length W1 of the element electrodes, the shape of conductive thin film 4, and so on are designed taking account of application forms and other factors. The electrode distance L1 is preferably in the range of several thousand Å to several hundred $\mu$m and more preferably in the range of 1 $\mu$m to 100 $\mu$m in view of the voltage applied between the element electrodes or the like.

The element length W1 is in the range of several $\mu$m to several hundred $\mu$m in view of the resistance of the electrodes and electron emission characteristics. The thickness d of the element electrodes 2, 3 is in the range of 100 Å to 1 $\mu$m.

The electron emitting element is not made only in the structure shown in FIGS. 5A and 5B, but may also be made in another structure where the conductive thin film 4 and the opposed electrodes 2, 3 are laid in the named order on the substrate 1.

The conductive thin film 4 is preferably a fine particle film comprised of fine particles, in order to obtain good electron emission characteristics. The thickness of the thin film 4 is properly determined in view of step coverage for the element electrodes 2, 3, the resistance between the element electrodes 2, 3, forming conditions described hereinafter, and so on. The thickness of the thin film 4 is normally preferably in the range of several Å to several thousand Å and more preferably in the range of 10 Å to 500 Å. The resistance of the thin film 4 is determined so that Rs is a value in the range of $10^2$ to $10^7$ Ω. Rs is a value obtained when the resistance R of the thin film having the thickness t, the width w, and the length 1 is defined as R=Rs (1/w), and it is expressed by Rs=p/t where ρ is the resistivity of the material for the thin film. In the present specification, the forming process will be described with examples of electrification process, but the forming process is not limited to this process. The forming process may be any method that can form the high resistance state by producing the crack in the film.

The material for the conductive thin film 4 is properly selected from metals such as Pd, Pt, Ru, Ag, Au, Ti, In, Cu, Cr, Fe, Zn, Sn, Ta, W, and Pb; oxides such as PdO, $SnO_2$, $In_2O_3$, PbO, and $Sb_2O_3$; borides such as $HfB_2$, $ZrB_2$, $LaB_6$, $CeB_6$, $YB_4$, and $GdB_4$; carbides such as TiC, ZrC, HfC, TaC, SiC, and WC; nitrides such as TiN, ZrN, and HfN; semiconductors of Si, Ce, or the like; carbon, and so on.

The fine particle film stated herein is a film as an aggregate of plural fine particles and the microstructure thereof is a state in which the fine particles are dispersed separately or a state in which the fine particles are adjacent or overlap each other (including a state in which some fine particles aggregate to form the island structure as a whole). Particle sizes of the fine particles are in the range of several Å to 1 μm and preferably in the range of 10 Å to 200 Å.

A method for forming the conductive thin film of the surface conduction type electron emitting element according to the present invention will be described referring to FIGS. 1A and 1B, FIGS. 5A and 5B, FIG. 6, FIG. 7, and FIGS. 14A to 14C.

Figure 1A:
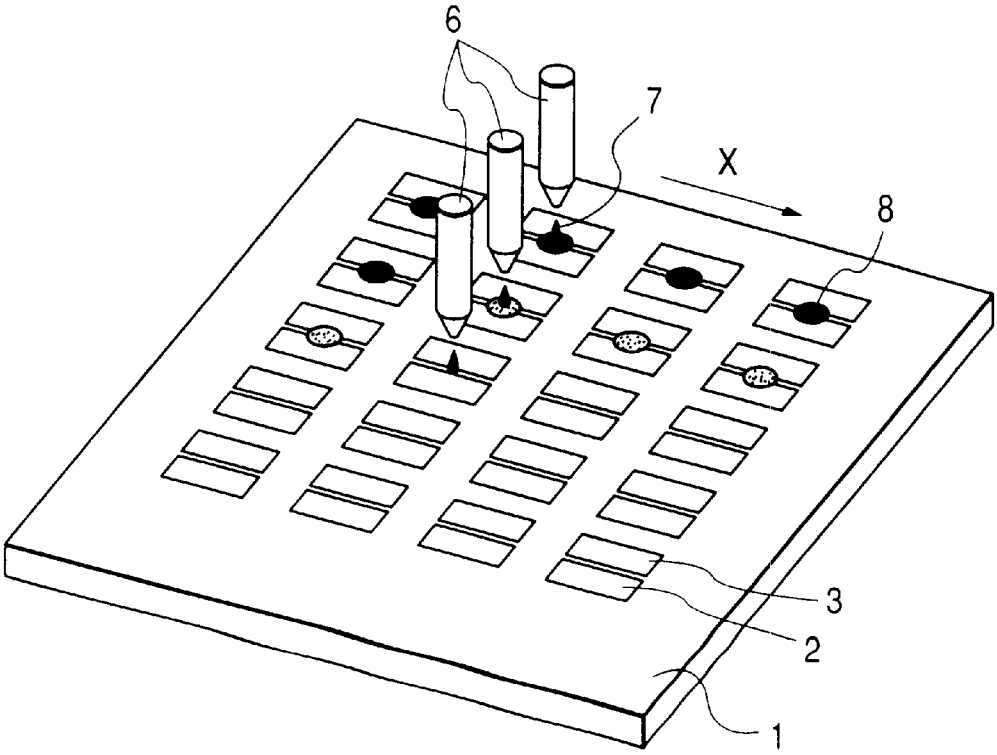
FIG. 1A and FIG. 1B are schematic, explanatory drawings to illustrate a droplet dispensing method as an embodiment of the present invention.
Figure 1B:
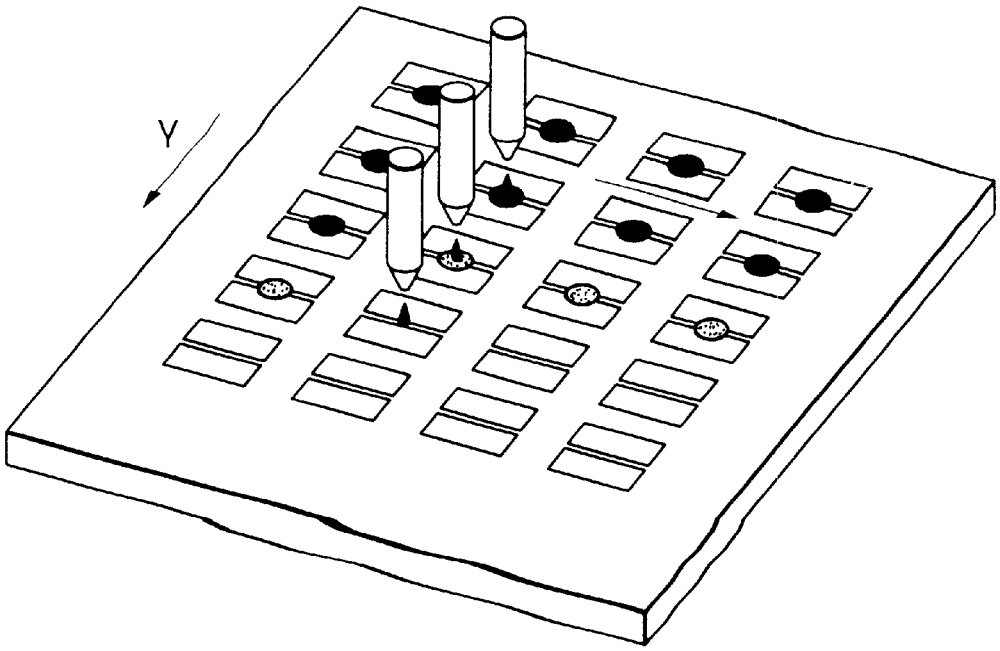

FIGS. 1A and 1B are drawings to best show the feature of the present invention. The mechanism of droplet dispensing device 6 may be any mechanism that can dispense a constant amount of arbitrary liquid and a particularly desirable mechanism is the one of the ink jet method capable of forming a droplet of approximately several ten ng. The ink jet method may be either one of the piezo jet method using the piezoelectric device, the bubble jet method to generate a bubble by use of thermal energy of heater, and so on.

Figure 6:
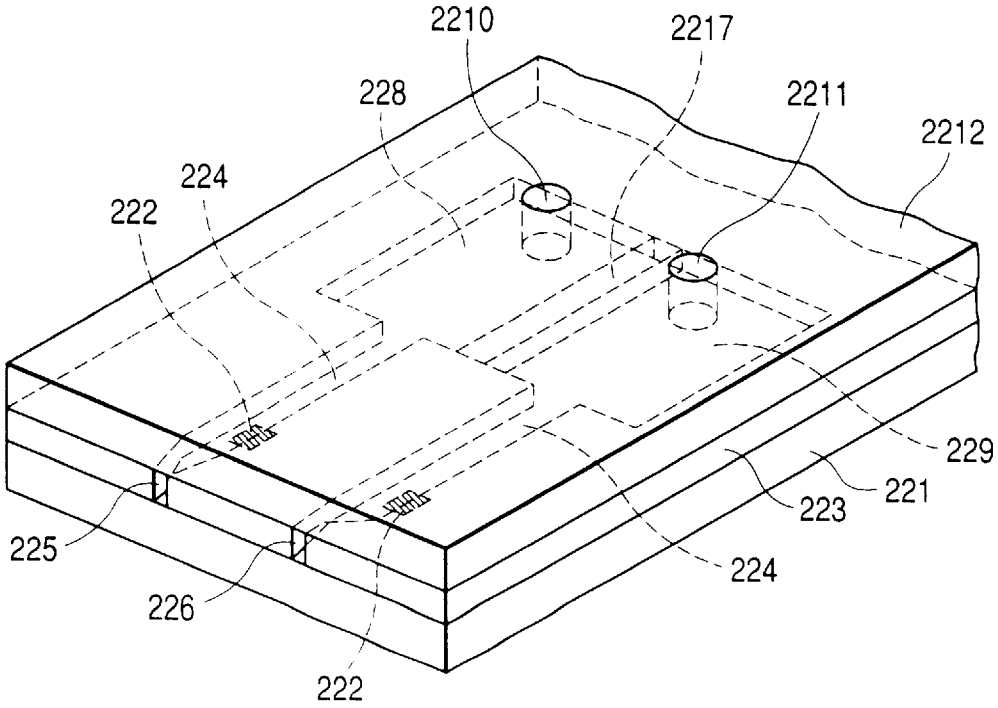
FIG. 6 is a perspective view to show an example of an ink jet head that can be used in the present invention.
Figure 7:
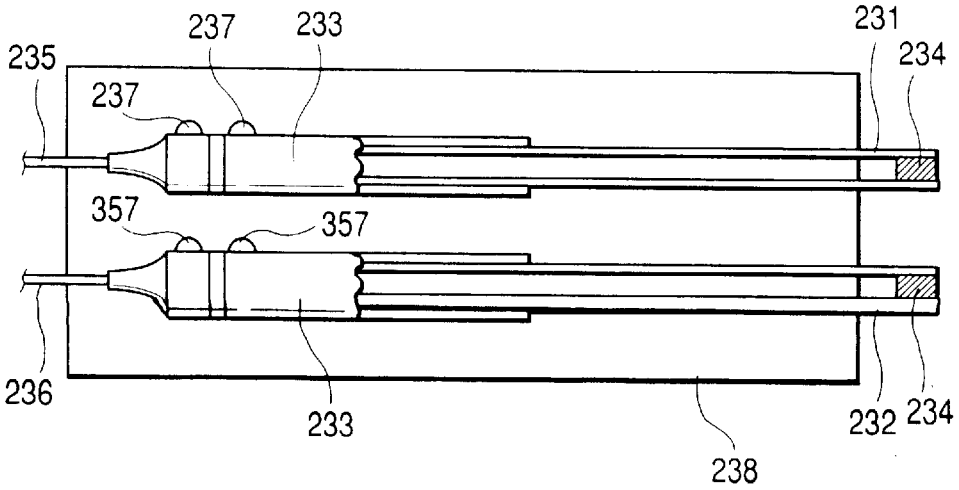
FIG. 7 is a drawing to show another example of an ink jet head that can be used in the present invention.

Examples of the droplet dispensing device 6 are shown in FIGS. 6 and 7. FIG. 6 illustrates the structure of the droplet dispensing device of the bubble jet method. In the same figure, numeral 221 denotes a substrate, 222 heat generating sections, 223 a support substrate, 224 liquid flow paths, 225 a first nozzle, 226 a second nozzle, 2217 a partition wall between ink flow paths, 228, 229 ink fluid chambers, 2210, 2211 supply ports of ink fluid, and 2212 a ceiling board.

FIG. 7 shows the structure of the droplet dispensing device of the piezo jet method. Ifn FIG. 7 numeral 231 designates a first nozzle made of glass, 232 a second nozzle made of glass, 233 cylindrical piezoelectric devices, 234 filters, 235, 236 ink fluid supply tubes, and 237 input terminals for electric signal. In FIGS. 6 and 7 there are two nozzles illustrated, but the number of nozzles is not limited to 2.

Material for the droplet 7 can be one selected from solutions, organic solvents, etc. containing an element or a compound that can make the conductive thin film described previously. For example, the following materials are examples where the element or the compound to become the conductive thin film is a palladium based one; aqueous solutions containing an ethanolamine-based complex such as palladium acetate-monoethanolamine complex (PA-ME), palladium acetate-diethanolamine complex (PA-DE), palladium acetate-triethanolamine complex (PA-TE), palladium acetate-butyl ethanolamine complex (PA-BE), or palladium acetate-dimethyl ethanolamine complex (PA-DME); aqueous solutions containing an amino-acid-based complex such as palladium-glycine complex (Pd-Gly), palladium-β-alanine complex (Pd-β-Ala), or palladium-DL-alanine complex (Pd-DL-Ala); butyl acetate solution of palladium acetate-bisdipropylamine complex, and so on.

The droplet dispensing method will be described referring to FIGS. 1A and 1B. In FIGS. 1A and 1B, reference numeral 1 designates a substrate, 2, 3 element electrodes of electron emitting element, 6 an ink jet head or droplet dispensing device, 7 droplets discharged from the ink Jet nozzles, and 8 droplets of conductive thin film having been dispensed on the substrate. Using the droplet dispensing device 6 having m (m>1) nozzles arranged at substantially the same intervals as the element intervals in the direction of column as shown in FIGS. 1A and 1B, n (n>1) droplets are dispensed to each element portion. The operation on that occasion is carried out as follows; a single droplet is applied to each of elements of m rows by one scan with the all m nozzles discharging the droplets (FIG. 1A); then the droplet dispensing device is moved relative to the electron source substrate in the direction of the nozzle string by a distance of one element and a single droplet is applied again to each of elements of m rows by one scan as described above with the all m nozzles discharging the droplets (FIG. 1B); the foregoing step is repeated to dispense totally n droplets to each element through the plural nozzles. After the droplets are laid between the all element electrodes on the electron source substrate, the substrate is baked at near 350° C., though depending upon the metal-containing solution used, thereby forming the conductive thin film.

This method permits the droplets to be dispensed in the period of about 1/m times that by the method for dispensing the n droplets with a single nozzle. If the dispensing method is such that n droplets are dispensed to each element from a certain nozzle by n scans with the m nozzles, there will sometimes appear dispersion in resistances of elements due to dispersion in delivery amounts from the m individual nozzles; whereas the method of this embodiment for dispensing the droplets to each element through the plural nozzles can lower the dispersion in resistances of elements without fine adjustment of delivery amounts. It is preferable to satisfy the condition of n≧m>1. Under this condition the n droplets are dispensed through the m nozzles to form each conductive thin film, so that the conductive thin films are more averaged.

The present embodiment showed the example where the scans were carried out in the direction of row (in the X-direction) using the droplet dispensing device with the nozzles corresponding to the element intervals along the direction of column, but, without having to be limited to this, the scans and dispensing can be carried out in the direction of column using the droplet dispensing device with the nozzles corresponding to the element intervals along the direction of column (in the Y-direction).

The electron emitting section 5 shown in FIG. 5 will be described. The electron emitting section 5 is comprised of the gap of high resistance formed in a part of the conductive thin film 4 and is dependent on the thickness of the conductive thin film 4, the quality of the film, the material for the film, the techniques such as the energization forming described hereinafter, and so on. In some cases the electron emitting section 5 contains conductive fine particles having the particle sizes of 1000 Å or less. The conductive fine particles are those containing some elements or the all elements of the material making the conductive thin film 4. The gap and the conductive thin film 4 in the vicinity thereof may have film which contain carbon or a carbon compound.

Figure 8A:
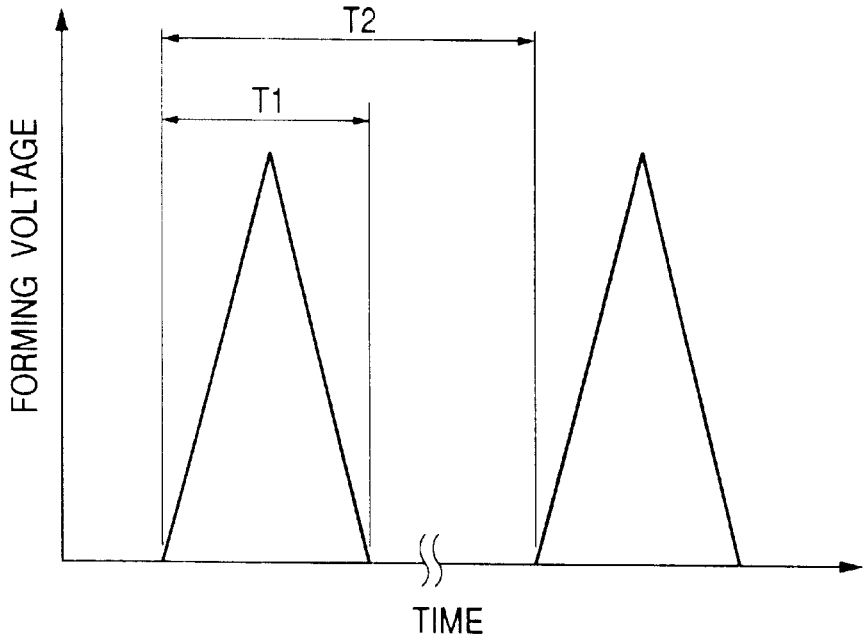
FIG. 8A and FIG. 8B are schematic diagrams to show examples of voltage waveforms in the energization forming process, which can be employed for production of the surface conduction type electron emitting element of the present invention.
Figure 8B:
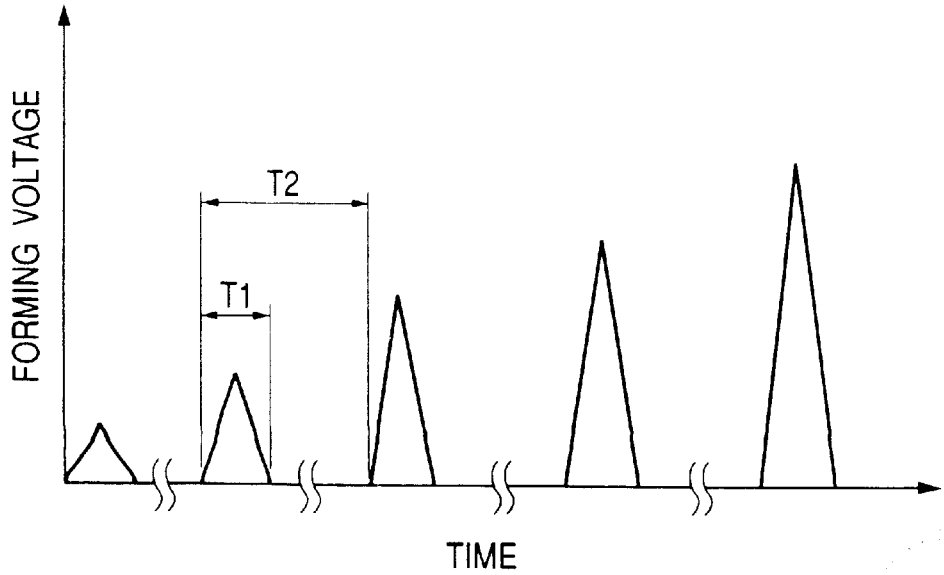

For forming the electron emitting section 5, the conductive thin film 4 formed as described above undergoes the forming process and activation process. A method by the electrification process will be described as an example of this forming method. When power from a power supply not illustrated is placed between the element electrodes 2, 3, a portion of the conductive thin film 4 experiences change of structure, thereby forming the gap. This energization forming forms the structure-changed portion, locally broken, deformed, or altered, in the conductive thin film 4. FIGS. 8A and 8B show examples of waveforms of voltage for the energization forming.

The waveforms of voltage are preferably of a pulse shape. There are two techniques for applying such pulses; a technique for continuously applying pulses whose pulse peak value is a constant voltage, as shown in FIG. 8A; a technique for applying voltage pulses with increasing pulse peak values, as shown in FIG. 8B.

In FIG. 8A T1 and T2 represent the pulse width and pulse interval of voltage waveform. The pulse width T1 is normally set in the range of 1 $\mu$sec to 10 msec and the pulse interval T2 normally in the range of 10 $\mu$sec to 100 msec. The peak value of triangular wave (the peak voltage upon the energization forming) is properly selected according to the form of the surface conduction type electron emitting element. Under these conditions, the voltage is applied for several seconds to several ten minutes, for example. The pulse waveform is not limited to the triangular wave, but a desired waveform, for example such as a rectangular wave, may also be adopted.

In FIG. 8B T1 and T2 may be the same as those shown in FIG. 8A. The peak values of triangular waves (peak voltages upon the energization forming) can be increased, for example, in steps of about 0.1 V.

Completion of the energization forming process can be detected by applying a voltage too low to locally break or deform the conductive thin film 4 during the period of pulse interval T2 and measuring a current. For example, the voltage of about 0.1 V is applied and the element current is measured to obtain a resistance at that time. When the resistance reaches 1 MΩ or more, the energization forming is terminated.

The element after forming is preferably subjected to an activation treatment. The activation step considerably changes the element current If and emission current Ie.

The activation treatment can be effected by repetitively applying pulses, in the same manner as in the case of the energization forming, under an atmosphere containing a gas of organic substance, for example. This atmosphere can be formed, for example, by utilizing an organic gas remaining in the atmosphere where the inside of a vacuum container is evacuated using an oil diffusion pump or a rotary pump; or by introducing a gas of appropriate organic substance into a vacuum achieved after sufficient evacuation with an ion pump or the like. The preferred pressure of the gas of organic substance at this time is properly determined depending upon the circumstance, because the pressure differs depending upon the form of application described above, the shape of the vacuum container, the type of the organic substance, and so on. The appropriate organic substance is selected from aliphatic hydrocarbons of alkane, alkene, and alkyne, aromatic hydrocarbons, alcohols, aldehydes, ketones, amines, organic acids such as phenol, darboxylic acid, and sulfonic acid, and so on; more specifically, saturated hydrocarbons represented by $C_nH_{2n+2}$ such as methane, ethane, or propane; unsaturated hydrocarbons represented by the composition formula of $C_nH_{2n}$ or the like such as ethylene or propylene; benzene, toluene, methanol, ethanol, formaldehyde, acetaldehyde, acetone, methyl ethyl ketone, methylamine, ethylamine, phenol, formic acid, acetic acid, propionic acid, and so on. This treatment causes carbon or a carbon compound to be deposited on the gap or in the vicinity thereof on the conduction film from the organic substance present in the atmosphere, whereby the element current If and emission current Ie are changed remarkably. Completion of the activation step is determined by measuring the element current If and emission current Ie. The pulse width, the pulse interval, and the pulse peak value are determined as occasion may demand.

The carbon or carbon compound described above is graphite (including the both monocrystalline and polycrystalline graphite) or amorphous carbon (amorphous carbon and carbon containing a microcrystalline mixture of amorphous carbon and the graphite), and the thickness thereof is preferably not more than 500 Å and more preferably not more than 300 Å.

The electron emitting element obtained through the activation step is preferably subjected to a stabilization treatment. This treatment is carried out preferably under such a condition that the partial pressure of the organic substance in the vacuum container is $1\times10^{-8}$ Torr or less, desirably not more than $1\times10^{-10}$ Torr. The pressure inside the vacuum container is preferably $1\times10^{-6.5}$ to 10–7 Torr and particularly preferably not more than $1\times10^{-8}$ Torr. A vacuum evacuation device for evacuating the vacuum container is preferably one not using oil, in order to prevent the oil from the device from affecting the characteristics of element. Specifically, such devices are vacuum evacuating devices such as an absorption pump and an ion pump. When the inside of the vacuum container is evacuated (in particular, at the stabilization processing), the whole vacuum container is preferably heated, thereby facilitating evacuation of molecules of the organic substance adsorbing on the internal wall of the vacuum container and on the electron emitting element. The evacuation conditions in the heated state at this time are desirably 80 to 200° C. for 5 or more hours, but, without being limited particularly to these conditions, the evacuation conditions vary depending upon various conditions including the size and shape of the vacuum container, the configuration of the electron emitting element, and so on. The partial pressure of the organic substance is obtained by measuring partial pressures of organic molecules whose principal components are carbon and hydrogen and whose mass numbers are 10 to 200 by mass spectrometer and adding up those partial pressures.

The atmosphere during driving after completion of the stabilization step is preferably the one at completion of the above stabilization treatment, but, without having to be limited to this, sufficiently stable characteristics can be maintained even with a little decrease in the degree of vacuum itself as long as the organic substance is removed well.

When this vacuum atmosphere is adopted, new carbon or carbon compound can be prevented from being deposited on the electron emitting section, which in turn stabilizes the element current If and emission current Ie.

Image forming apparatus of the present invention will be described below.

A variety of configurations may be adopted for the electron emitting elements of electron source substrate used in the image forming apparatus. A first example is a ladder configuration in which a number of electron emitting elements arranged in parallel are connected each at the both ends to form many rows of electron emitting elements (defining the row direction) and in which electrons from the electron emitting elements are controlled and driven by control electrodes (also called a grid) disposed above the electron emitting elements and in the direction (called the column direction) perpendicular to the wires.

Another example is a configuration in which a plurality of electron emitting elements are arrayed in a matrix in the row direction and in the column direction, one-side electrodes of plural electron emitting elements disposed in each of rows are connected to a common wire in the row direction, and other-side electrodes of plural electron emitting elements disposed in each column are connected to a common wire in the column direction. This is a so-called simple matrix configuration. This simple matrix configuration will be detailed below.

Figure 3:
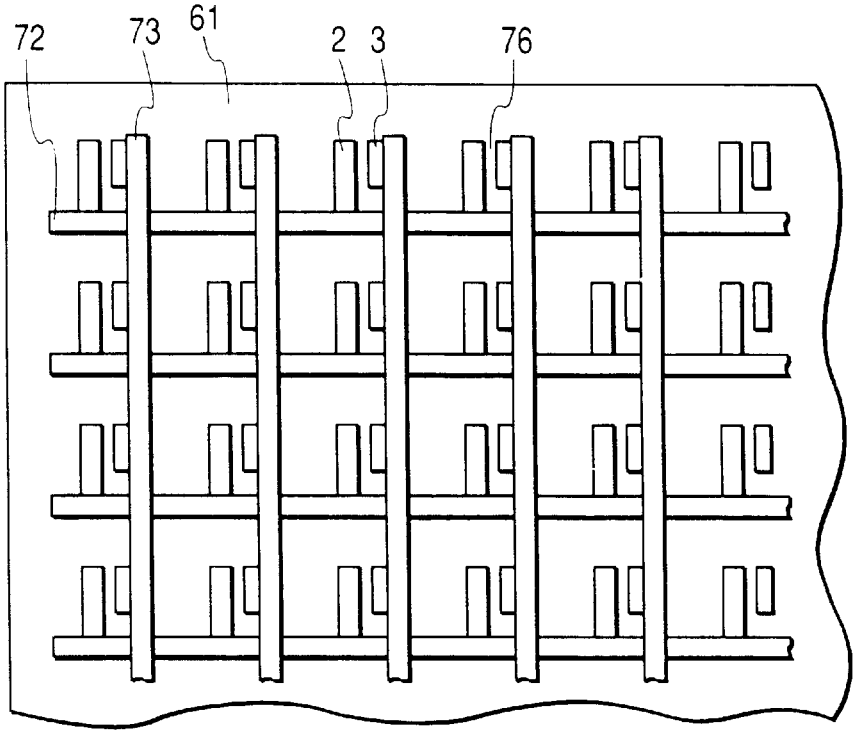
FIG. 3 is a schematic view of an electron source substrate of a matrix configuration type that can be utilized in the present invention.
Figure 9:
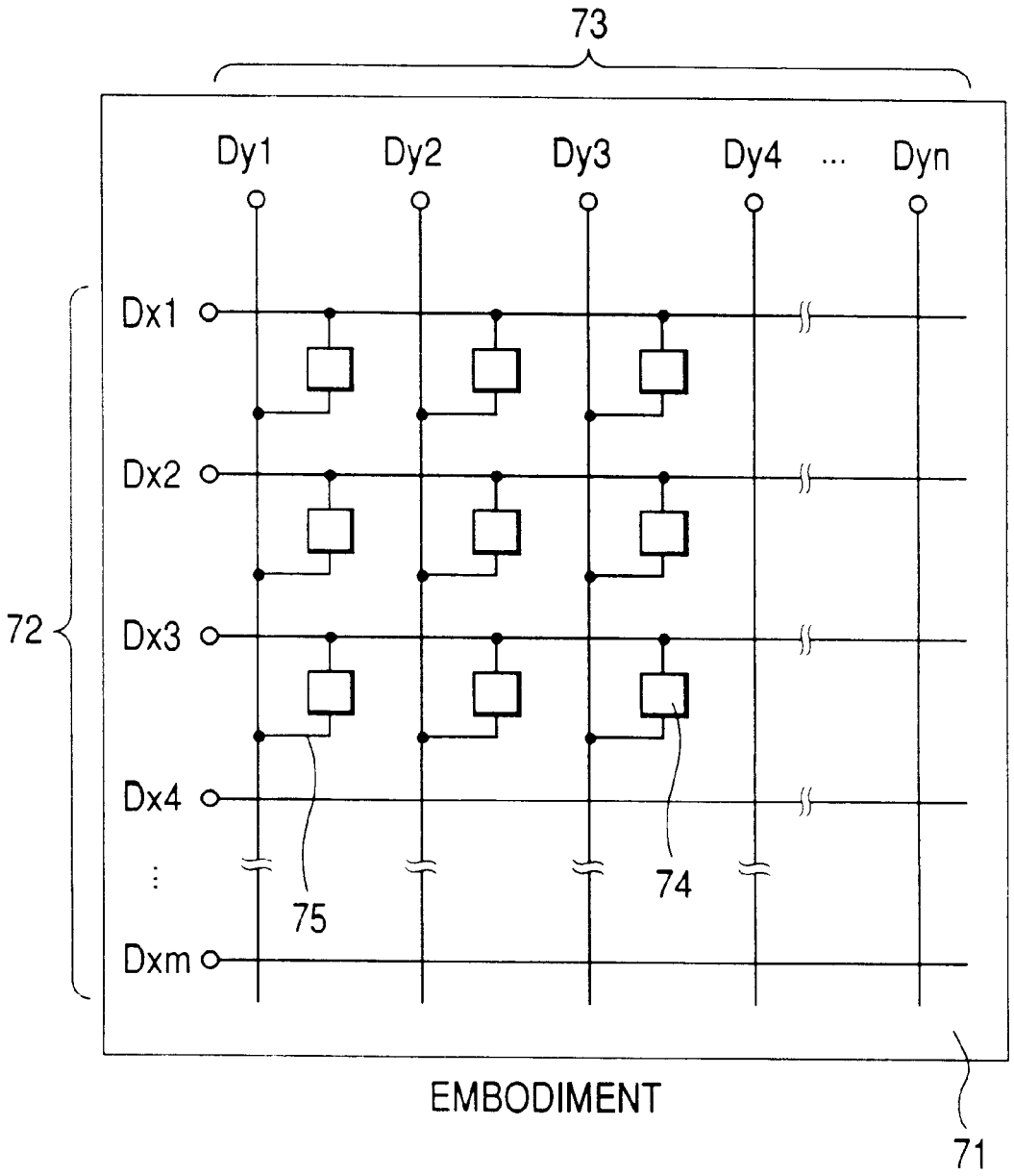
FIG. 9 is a schematic view to show an electron source substrate of the matrix configuration type that can be utilized in the present invention.

Now, let us explain an electron source substrate obtained by arraying a plurality of electron emitting elements in a matrix according to the present invention, by reference to FIG. 3 and FIG. 9. In these figures, reference numeral 71 designates an electron source substrate, 72 wires in the row direction, and 73 wires in the column direction. Numeral 74 denotes surface conduction type electron emitting elements and 75 connections.

The m row wires 72 are comprised of Dx1, Dx2,. . . , Dxm, which can be made of a conductive metal or the like. The material, the thickness, and the width of the wires are properly designed as occasion may demand. The column wires 73 are comprised of n wires of Dy1, Dy2, . . . , Dyn, which are also made in the same manner as the row wires 72. An interlayer insulating layer not illustrated is interposed between these m row wires 72 and n column wires 73, so as to electrically isolate them from each other (where m and n both are positive integers).

The interlayer insulating layer not illustrated is made of $SiO_2$ or the like. The thickness, material, and production process of the interlayer insulating layer are determined so as to form the insulating layer in a desired shape entirely or partly on the substrate 71 with the row wires 72 formed thereon and, particularly, so as to make the insulating layer resistant to a potential difference at intersections between the row wires 72 and the column Y-direction wires 73. Each of the row wires 72 and column wires 73 is drawn out as an external terminal.

The paired electrodes (not illustrated), each pair for each of the surface conduction type electron emitting elements 74, are electrically connected with the m row wires 72 and n column wires 73 by the connections 75 of the conductive metal or the like.

The material for the wires 72 and wires 73, the material for the connections 75, and the material for the paired element electrodes may contain some identical constituent elements or all identical constituent elements or may be different from each other. These materials are properly selected, for example, from the aforementioned materials for the element electrodes. When the material for the element electrodes is the same as the wire material, the wires connected to the element electrodes can also be regarded as element electrodes.

Connected to the row wires 72 is a scan signal applying device, not illustrated, for applying a scan signal for selecting a row of surface conduction type emitting elements 74 arranged along the row direction. On the other hand, connected to the column wires 73 is a modulation signal generator, not illustrated, for modulating each column of surface conduction type emitting elements 74 arranged along the column direction according to an input signal. A driving voltage applied to each electron emitting element is supplied as a difference voltage between the scan signal and the modulation signal applied to the element.

In the above configuration, the individual elements can be selected and driven independently, using the simple matrix wires.

Figure 10:
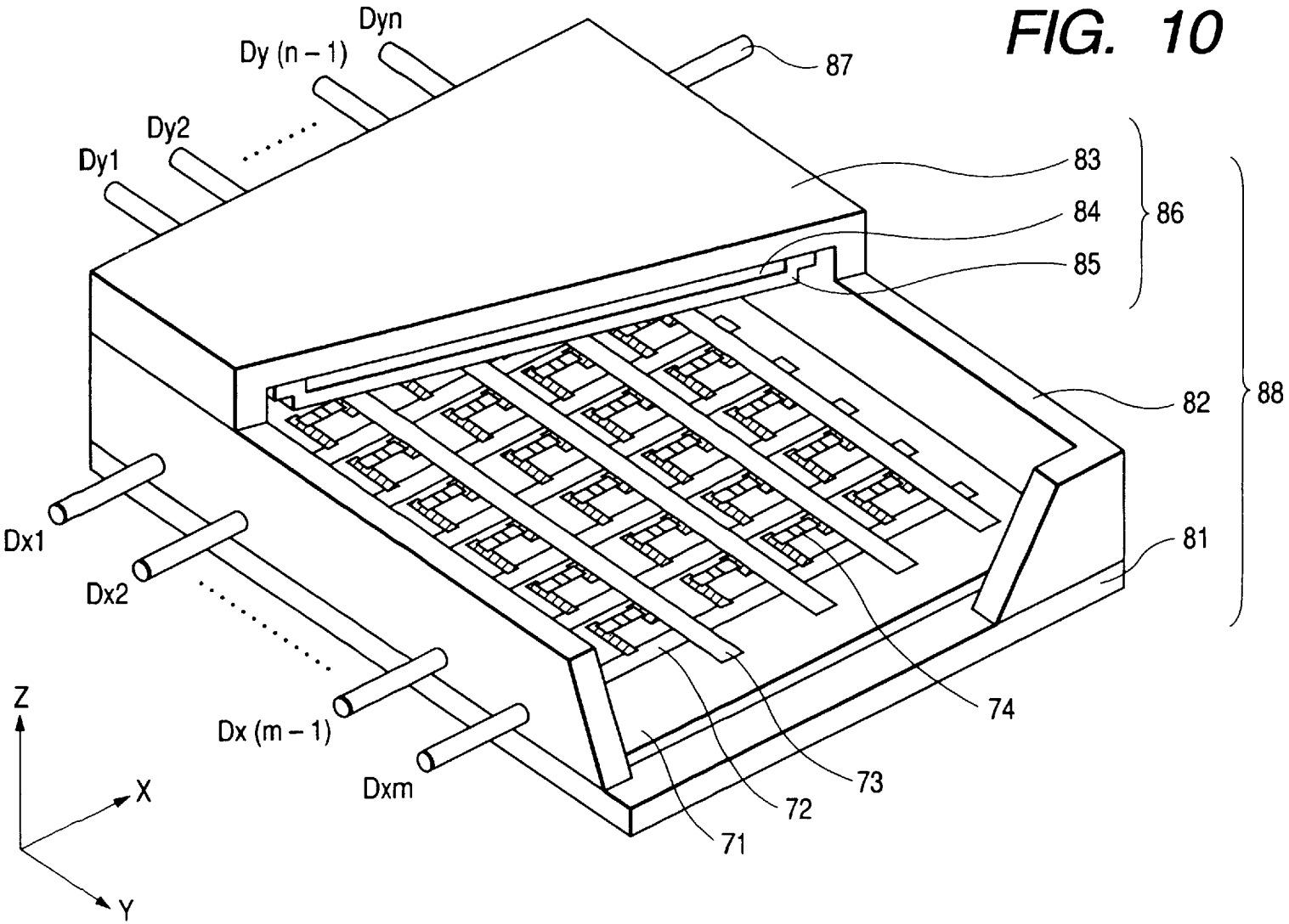
FIG. 10 is a schematic view to show a display panel of an image forming apparatus of matrix wires that can be utilized in the present invention.
Figure 11A:
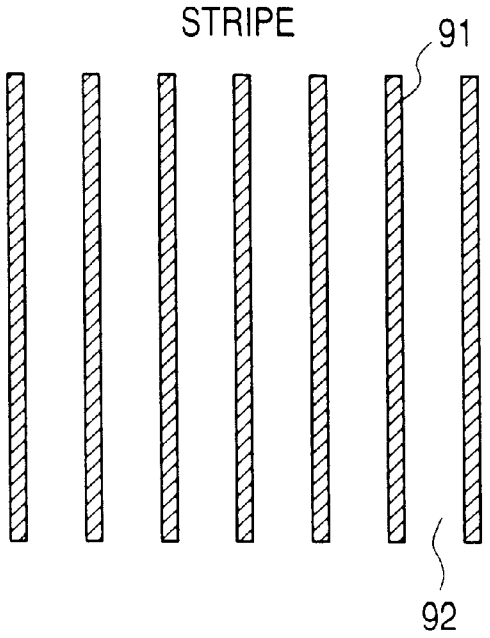
FIG. 11A and FIG. 11B are schematic views to show examples of fluorescent film used in the display panel of FIG. 10.
Figure 11B:
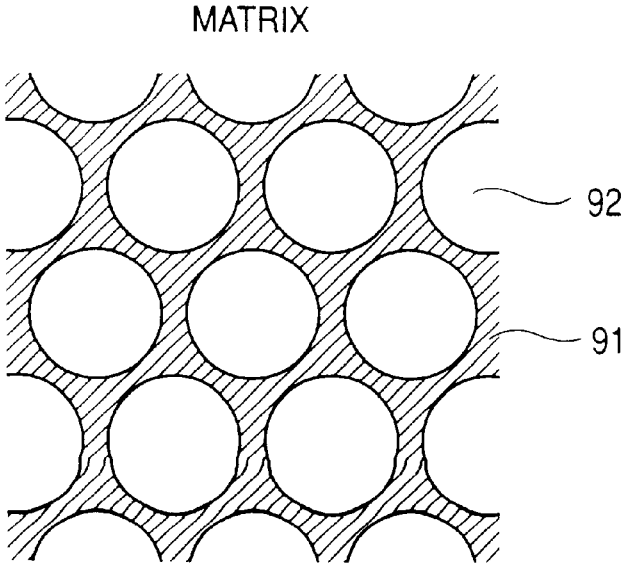
Figure 12:
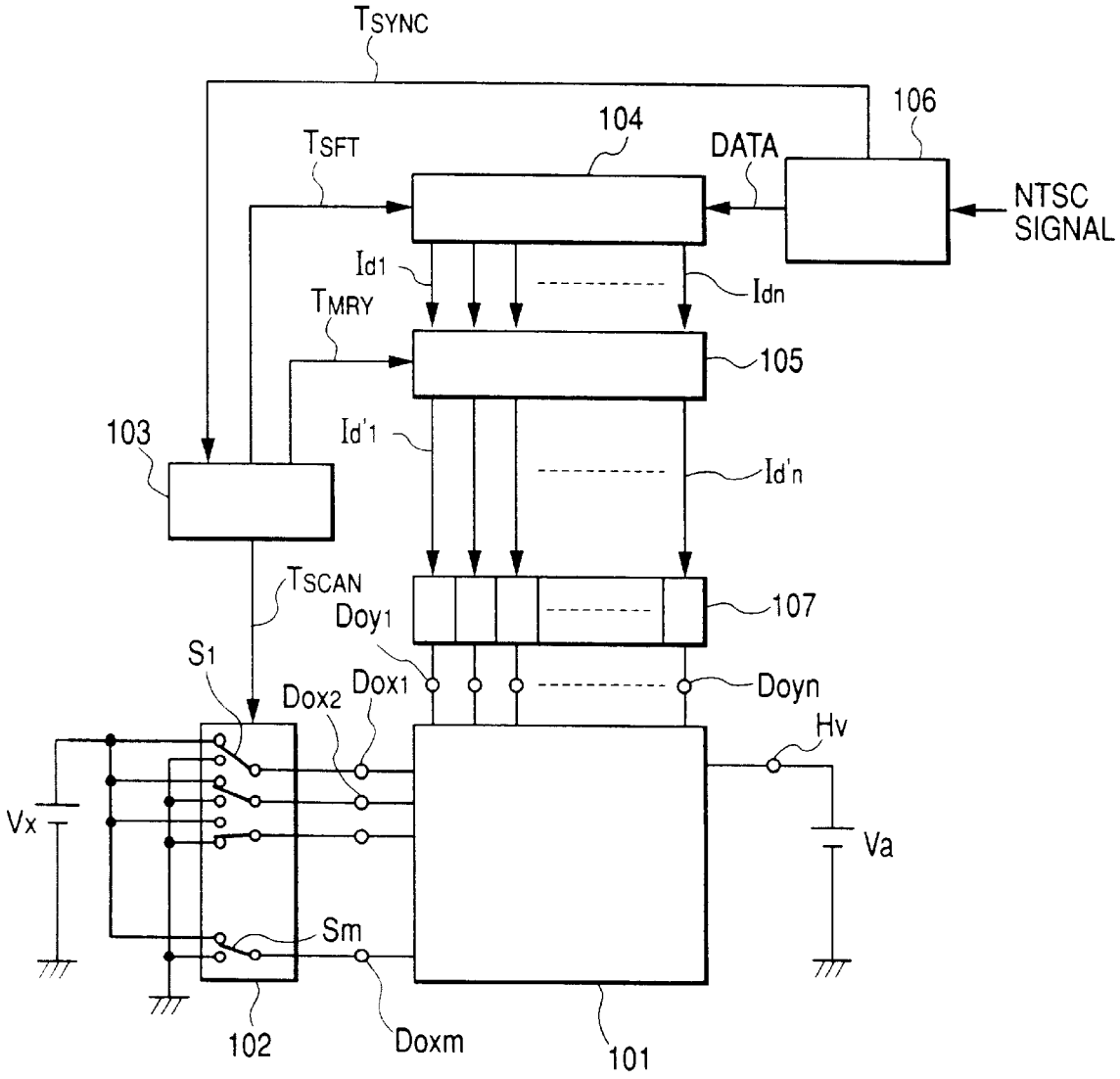
FIG. 12 is a block diagram to show an example of a driving circuit for display according to TV signals of the NTSC method, which can be used in the image forming apparatus of the present invention.

An image forming apparatus constructed using the electron source of such a simple matrix configuration will be described referring to FIG. 10, FIGS. 11A and 11B, and FIG. 12. FIG. 10 is a schematic diagram to show an example of a display panel of the image forming apparatus and FIGS. 11A and 11B are schematic diagrams of fluorescent films used in the image forming apparatus. FIG. 12 is a block diagram to show an example of a driving circuit for display according to TV signals of the NTSC method.

In FIG. 10, numeral 71 designates an electron source substrate on which a plurality of electron emitting elements shown in FIG. 1 are arrayed, 81 a rear plate on which the electron source substrate 71 is fixed, and 86 a face plate in which fluorescent film 84 and metal back 85 are formed on the internal surface of glass substrate 83. Numeral 82 indicates a support frame, and the rear plate 81 and face plate 86 are connected to the support frame 82 by use of frit glass or the like. Numeral 88 represents an enclosure composed of these components, for example obtained by baking them in the temperature range of 400 to 500° C. in the atmosphere or in nitrogen for 10 or more minutes so as to effect sealing.

Numeral 74 corresponds to one element out of the surface conduction type electron emitting elements shown in FIGS. 5A and 5B. Numerals 72 and 73 denote the row wires and column wires connected to the element electrodes of the respective pairs of surface conduction type electron emitting elements.

The enclosure 88 is composed of the face plate 86, support frame 82, and rear plate 81 as described above. Since the rear plate 81 is provided mainly for the purpose of reinforcing the electron source substrate 71, the separate rear plate 81 does not have to be provided if the electron source substrate 71 itself has sufficient strength. Namely, the enclosure 88 may be constructed of the face plate 86, support frame 82, and substrate 71 by coupling the substrate 71 directly with the support frame 82 by sealing. On the other hand, the enclosure 88 having sufficient strength against the atmospheric pressure can also be constructed by installing an unrepresented support called a spacer (atmospheric-pressure-resistant support member) between the face plate 86 and the rear plate 81.

FIGS. 11A and 11B are schematic diagrams to show examples of the fluorescent film. In the monochrome case the fluorescent film can be constructed of only fluorescent substance. A color fluorescent film can be made of black member 91 and fluorescent substance 92 in a pattern called black stripes or a black matrix depending upon the configuration of fluorescent substance. Purposes of providing the black stripes or black matrix are to quiet mixture of colors or the like by blacking the coating borders between the fluorescent areas 92 of the necessary three primary colors and to suppress decrease in contrast due to reflection of external light. The material for the black stripes can be a material whose principal component is graphite, which is normally used, or any material with little transmission and little reflection of light.

A method for coating the glass substrate 83 with the fluorescent substance is a precipitation method, a printing method, or the like, irrespective of either monochrome or color. The metal back 85 is normally provided on the internal surface of the fluorescent film 84. Purposes for provision of the metal back are to increase the luminance by regularly reflecting light on the internal surface side out of emission light from the fluorescent substance, toward the face plate 86 side, to make the metal back act as an electrode for applying an electron beam accelerating voltage, to protect the fluorescent substance from damage due to collision with negative ions generated in the enclosure, and so on. The metal back can be made in such a way that after production of the fluorescent film, a smoothing process (normally called "filming") is carried out for the surface on the internal surface side of the fluorescent film and thereafter a film of Al or the like is deposited thereon.

The face plate 86 may also be provided with a transparent electrode (not illustrated) on the external surface side (on the glass substrate 83 side) of the fluorescent film 84 in order to enhance the conductive property of the fluorescent film 84.

On the occasion of execution of the aforementioned sealing, sufficient alignment is indispensable in the color case, because the fluorescent areas of the respective colors need to be positioned in correspondence to the associated electron emitting elements.

The image forming apparatus shown in FIG. 10 is fabricated, for example, in the following manner. The enclosure 88 is evacuated through an unillustrated exhaust pipe by an evacuating device not using oil, such as the ion pump or the absorption pump, while being heated, if necessary, in the same manner as in the aforementioned stabilization step; the enclosure is sealed after the ambience reaches one with sufficiently decreased organic substance in the vacuum of about $10^{-7}$ Torr. A getter process can also be applied in order to maintain the degree of vacuum after the sealing of the enclosure 88. This getter process is a process for forming an evaporated film by heating a getter located at a predetermined position (not illustrated) in the enclosure 88 by heat generated by resistance heating or high-frequency heating immediately before the sealing of the enclosure 88 or after the sealing. The principal component of the getter is normally Ba etc., and the vacuum of $1\times10^{-5}$ to $1\times10^{-7}$ [Torr] is maintained by adsorbing action of the evaporated film, for example.

Next described referring to FIG. 12 is a configuration example of the driving circuit for TV display based on the TV signals of the NTSC method on the display panel constructed using the electron source of the single matrix configuration. In FIG. 12, numeral 101 denotes an image display panel, 102 a scanning circuit, 103 a controlling circuit, and 104 a shift register. Numeral 105 represents a line memory, 106 a synchronizing signal separating circuit, 107 a modulation signal generator, and Vx and Va dc voltage supplies.

The display panel 101 is connected to the external electric circuits through terminals Doxl to Doxm, terminals Doy1 to Doyn, and a high voltage terminal Hv. Applied to the terminals Dox1 to Doxm are scan signals for successively driving the electron source disposed inside the display panel, i.e., the surface conduction type electron emitting element group of the matrix wire configuration of M rows×N columns line by line (N elements).

Applied to the terminals Doy1 to Doyn are modulation signals for controlling output electron beams of the respective elements in one row of surface conduction type electron emitting elements selected by a scan signal described above. A dc voltage of 10 K[V], for example, is supplied from dc voltage supply Va to the high voltage terminal Hv and this voltage is an acceleration voltage for imparting sufficient energy for excitation of the fluorescent substance to the electron beams emitted from the surface conduction type electron emitting elements.

The scanning circuit 102 will be described below. This circuit has M switching elements inside (schematically shown by S1 to Sm in the drawing). Each switching element selects either one of the output voltage from do voltage supply Vx or 0 [V] (the ground level) to be electrically coupled with the terminal Dox1 to Doxm of the display panel 101. The switching elements of S1 to Sm operate based on a control signal Tscan outputted from the controlling circuit 103 and are constructed of a combination of switching devices such as FETs, for example.

The dc voltage supply Vx in this example is set so as to output such a constant voltage that the driving voltage applied to the unscanned elements is not more than an electron emission threshold voltage, based on the characteristics (the electron emission threshold voltage) of the surface conduction type electron emitting elements.

The controlling circuit 103 has a function to match operations of the respective sections with each other so as to achieve appropriate display based on the image signals supplied from the outside. The controlling circuit 103 generates and sends each control signal of Tscan, Tsft, and Tmry to each section, based on the synchronizing signal Tsync sent from the synchronizing signal separating circuit 106.

The synchronizing signal separating circuit 106 is a circuit for separating synchronizing signal components and luminance signal components out of the TV signals of the NTSC method supplied from the outside, which can be constructed using an ordinary frequency separation (filter) circuit or the like. The synchronizing signals separated by the synchronizing signal separating circuit 106 consist of vertical synchronizing signal and horizontal synchronizing signal, but they are illustrated as Tsync signal for convenience' sake of explanation. The luminance signal components of image separated from the TV signals are denoted by DATA signals for convenience' sake. The DATA signals are supplied to the shift register 104.

The shift register 104 is provided for serial-parallel conversion line by line of image to convert the DATA signals serially supplied in time series to parallel signals. The shift register 104 operates based on the control signal Tsft sent from the controlling circuit 103 (which means that the control signal Tsft can also be said as shift clocks of the shift register 104). The data of one line of image (corresponding to driving data for N electron emitting elements) after the serial-parallel conversion is outputted as N parallel signals of Id1 to Idn from the shift register 104.

The line memory 105 is a storage device for storing data of one line of image during a desired period. The line memory 105 properly stores the contents of Id1 to Idn according to the control signal Tmry supplied from the controlling circuit 103. The stored contents are outputted as Id'1 to Id'n to be supplied to the modulation signal generator 107.

The modulation signal generator 107 is a signal source for properly driving and modulating each of the surface conduction type electron emitting elements according to each of the image data Id'1 to Id'n, and the output signals therefrom are applied to the surface conduction type electron emitting elements in the display panel 101 through the terminals Doy1 to Doyn.

The electron emitting elements according to the present invention have the following fundamental characteristics as to the emission current Ie. Namely, there is a definite threshold voltage Vth for emission of electron, and emission of electron occurs only when the voltage of not less than Vth is applied. With increasing voltages over the electron emission threshold value, the emission current also varies according to change in the applied voltage to the element. This tells us that when the voltage of the pulse shape is applied to the elements, emission of electron does not occur with application of the voltage below the electron emission threshold value, for example, but an electron beam is outputted with application of the voltage not less than the electron emission threshold value. On that occasion, the strength of the output electron beam can be controlled by changing the peak value Vm of pulse. The total amount of charge of the output electron beam can be controlled by changing the pulse width Pw. Therefore, the method for modulating the electron emitting elements can be selected from the voltage modulating method, the pulse width modulating method, and so on, depending upon the input signal. For carrying out the voltage modulation method, the modulation signal generator 107 can be a circuit of the voltage modulation method arranged to generate voltage pulses of a constant length and to properly modulate peak values of pulses according to the input data.

For carrying out the pulse width modulating method, the modulation signal generator 107 can be a circuit of the pulse width modulating method arranged to generate voltage pulses of a constant peak value and to properly modulate widths of voltage pulses according to the input data.

The shift register 104 and the line memory 105 can be those of the digital signal type or the analog signal type, because only an essential point is to carry out the serial-parallel conversion and storage of image signals at predetermined speed.

When they are of the digital signal type, the output signals DATA from the synchronizing signal separating circuit 106 need to be converted to digital signals and this is achieved simply by providing an A/D converter at the output part of 106. In connection with this, there is a small difference in the circuitry used in the modulation signal generator 107, depending upon whether the output signals from the line memory 105 are digital signals or analog signals. In the case of the voltage modulating method using the digital signals, the modulation signal generator 107 is, for example, a D/A converting circuit and an amplifying circuit is added if necessary. In the case of the pulse width modulating method, the modulation signal generator 107 is a circuit as a combination of a high-speed oscillator, a counter for counting waves outputted from the oscillator, and a comparator for comparing an output value from the counter with an output value from the memory, for example. In addition, the circuit may also be provided with an amplifier for amplifying a pulse-width-modulated modulation signal outputted from the comparator up to the driving voltage of the surface conduction type electron emitting elements, if necessary.

In the case of the voltage modulating method using the analog signals, the modulation signal generator 107 can be an amplifying circuit using an operation amplifier, for example, and a level shift circuit or the like can be added if necessary. In the case of the pulse width modulating method, for example, a voltage-controlled oscillator (VCO) can be employed, and an amplifier for amplifying the voltage up to the driving voltage of the surface conduction type electron emitting elements can also be added if necessary.

In the image display apparatus of this configuration, when the voltage is applied to each electron emitting element through the terminals Dox1 to Doxm and Doy1 to Doyn outside the package, the emission of electron occurs. The electron beams are accelerated by applying the high voltage to the metal back 85 or to the transparent electrode (not illustrated) through the high voltage terminal Hv. The accelerated electrons collide with the fluorescent film 84 to generate fluorescence therein, thus forming an image.

The structure of the image forming apparatus described herein is just an example, and it is noted that a variety of modifications can be made based on the technical concept of the present invention. The input signals were those of the NTSC methods but the input signals are not limited to these. For example, the input signals can also be of the PAL method, the SECAM method, or a method of TV signals consisting of more scan lines (for example, the high-definition TV method including the MUSE method).

Figure 4:
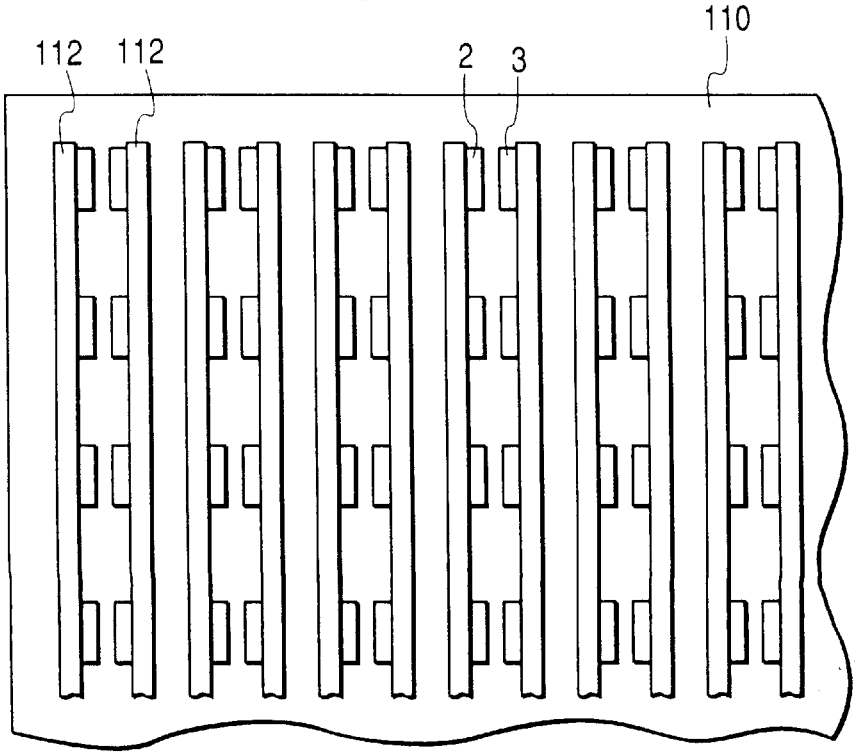
FIG. 4 is a schematic view of an electron source substrate of a ladder configuration type that can be utilized in the present invention.
Figure 13:
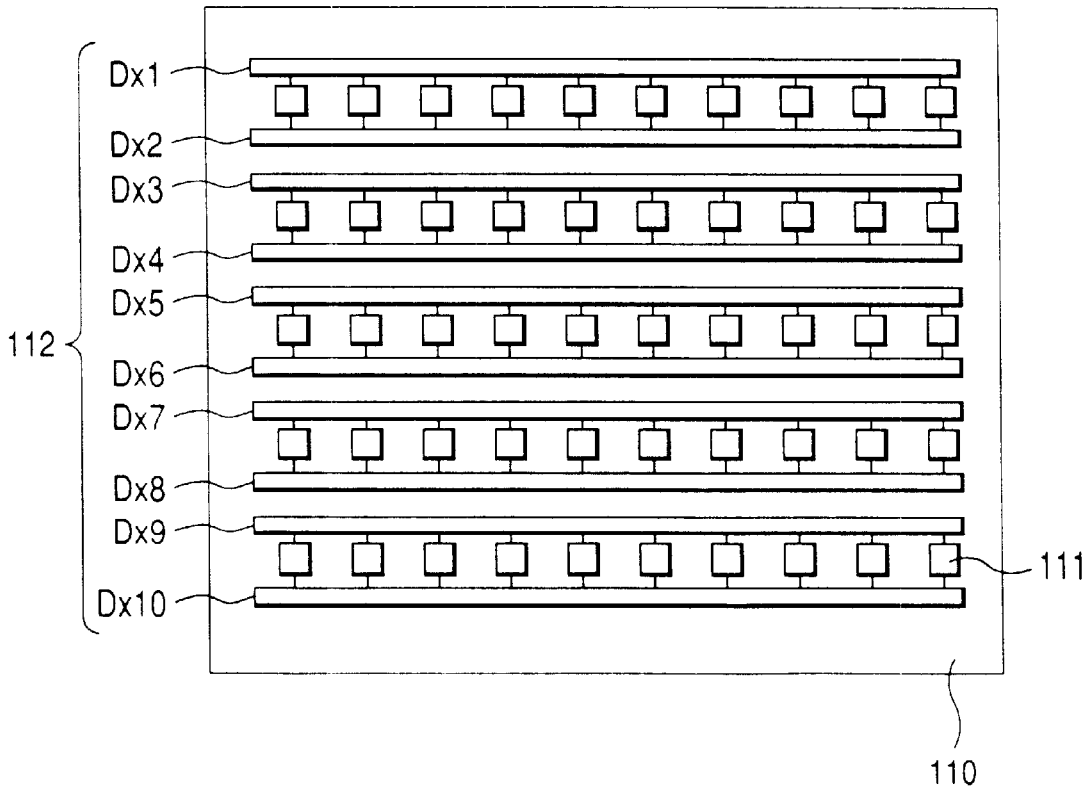
FIG. 13 is a schematic view to show an electron source substrate constructed of ladder type wires, which can be used in the present invention.
Figure 14A:
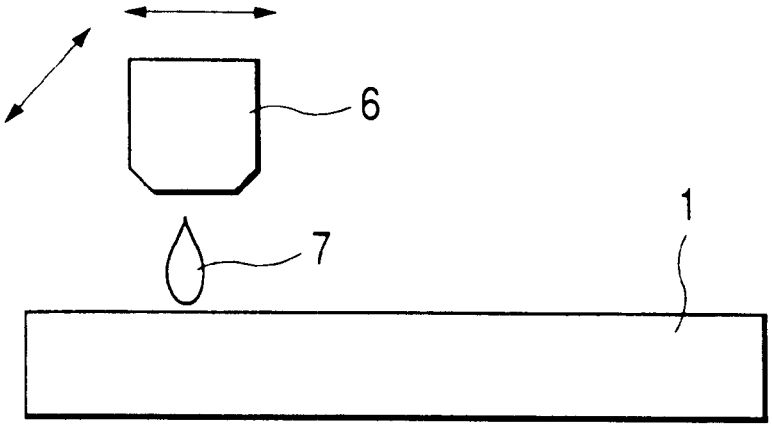
FIG. 14A, FIG. 14B, and FIG. 14C are schematic views to show an example of the conventional droplet dispensing method.
Figure 14B:
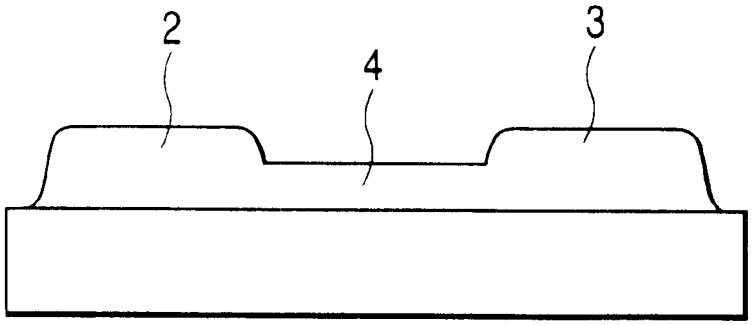
Figure 14C:
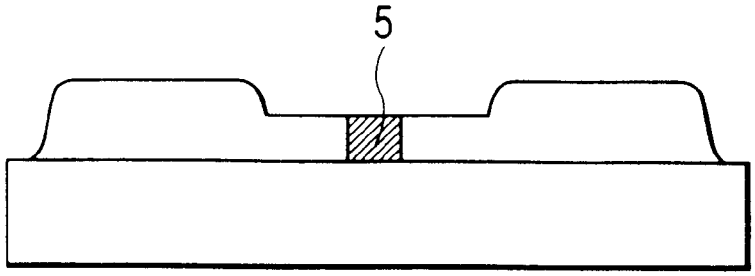
Figure 15:
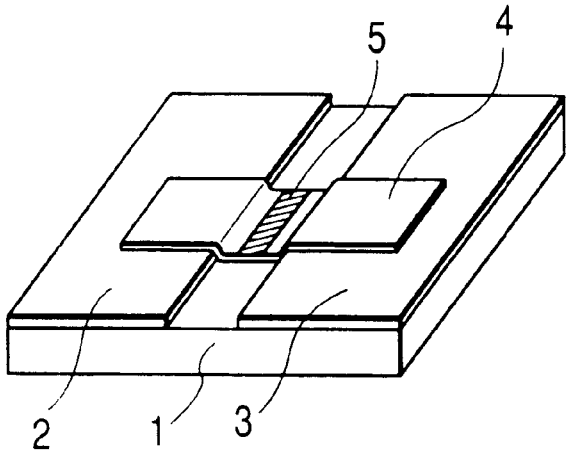
FIG. 15 is a schematic, perspective view of the conventional surface conduction type electron emitting element.
Figure 16:
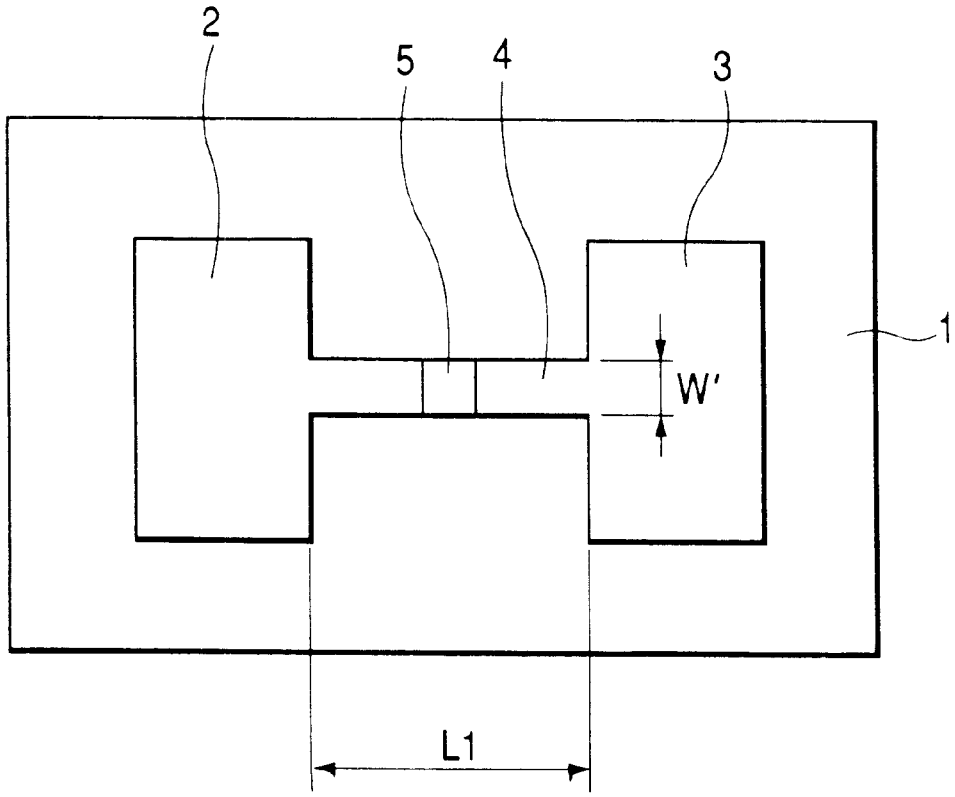
FIG. 16 is a schematic, plan view of the conventional surface conduction type electron emitting element.

The electron source and image forming apparatus of the ladder configuration will be described below referring to FIG. 4 and FIG. 13. FIG. 4 and FIG. 13 are schematic diagrams to show an example of the electron source of the ladder configuration. In FIGS. 4 and 13, numeral 110 designates an electron source substrate and 111 electron emitting elements. Numeral 112 (Dx1 to Dx10) are common wires for connecting the electron emitting elements 111. A plurality of electron emitting elements 111 are aligned in parallel in the X-direction on the substrate 110 (as will be called element rows). A plurality of such element rows are arranged to compose the electron source. When the driving voltage is placed between the common wires of each element row, each of the element rows can be driven independently of each other. Namely, the voltage over the electron emission threshold value is applied to the element rows desired to emit the electron beam and the voltage below the electron emission threshold value is applied to the element rows not desired to emit the electron beam. The common wires Dx2 to Dx9 between the element rows can be combined; for example, the wires Dx2 and Dx3 can be made as a single wire. The image forming apparatus can be constructed using this electron source in the same manner as that described referring to FIG. 10.

In the image forming apparatus of this example, the modulation signals of one line of image are simultaneously applied to the string of grid electrodes in synchronism with successive driving (scanning) of the element rows line by line. By this, the image can be displayed line by line while controlling radiation of each electron beam to the fluorescent substance.

The image forming apparatus fabricated according to the present invention can be used as display apparatus for television broadcasting, and as display apparatus for video conference system, computers, etc.; in addition, it can also be used as such image forming apparatus or the like as an optical printer constructed using a photosensitive drum or the like.

EXAMPLE

The present invention will be described in further detail with examples.

Example 1

Figure 2A:
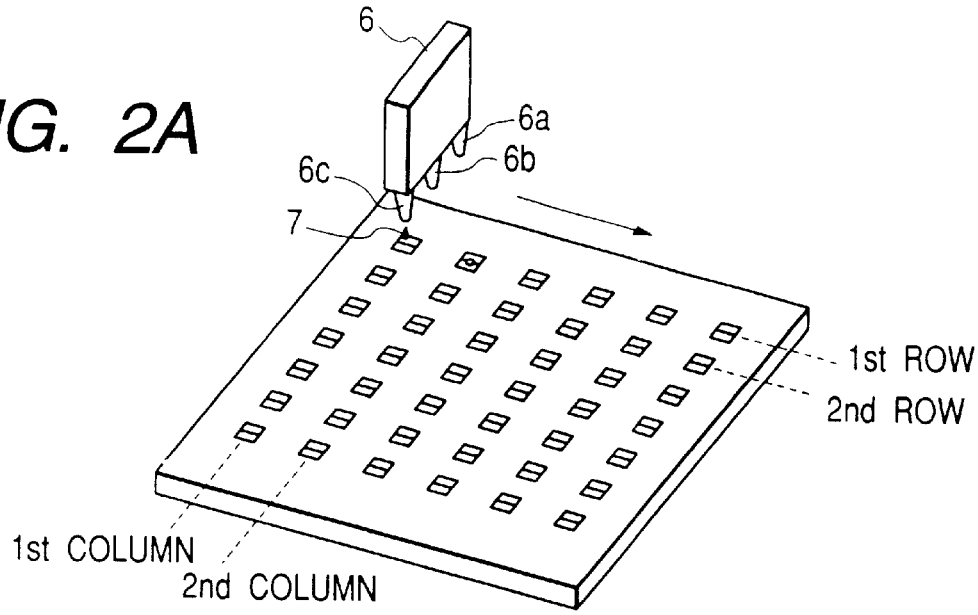
FIG. 2A, FIG. 2B, and FIG. 2C are schematic, explanatory drawings to illustrate a droplet dispensing method in an example of the present invention.
Figure 2B:
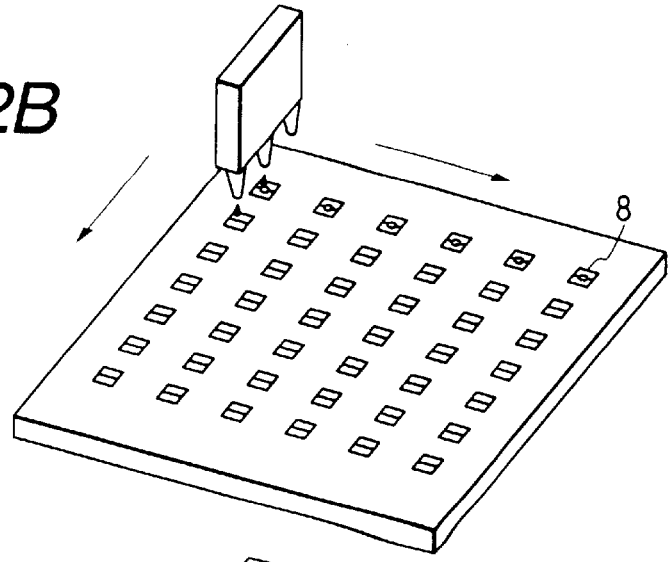
Figure 2C:
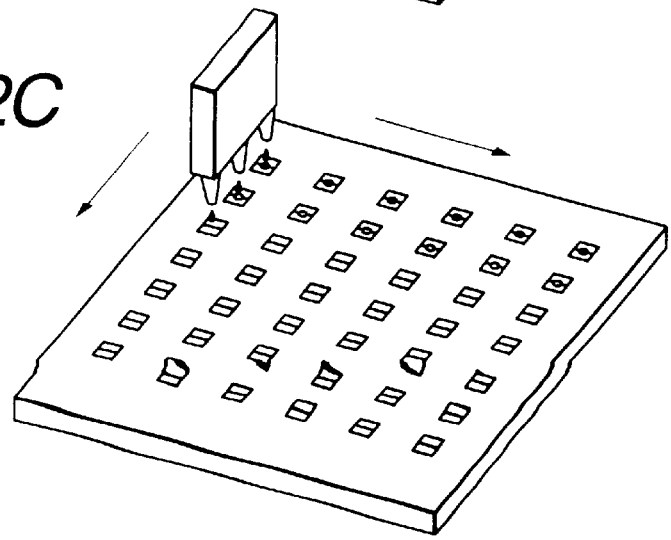

FIGS. 2A, 2B, and 2C are conceptual drawings to show a method for producing the electron source substrate, wherein three droplets are dispensed for each element, using the droplet dispensing device 6 having three nozzles aligned at the same intervals as the element intervals of the electron source substrate. An example of fabrication of this electron source substrate will be described.

First, the insulating substrate was a glass substrate 1. This was washed well with an organic solvent or the like and thereafter it was dried in a drying furnace at 120° C. Using the photolithography processes, a film of Pt (the thickness 500 Å) was deposited on the substrate, the paired element electrodes 2, 3 having the electrode width 200 μm and the electrode gap distance 20 μm were formed in the matrix of 500 rows and 1500 columns, totally 750000, at the intervals of 500 μm in the column direction and at the intervals of 700 μm in the row direction, and the electrodes were connected by wires not illustrated in FIGS. 2A to 2C. The wires employed were of the matrix configuration as shown in FIG. 3.

Then three droplets of solution 7 for each element were dispensed onto this substrate, through the ink jet head 6 having three nozzles arranged at the intervals of 500 μm (first nozzle 6*a*, second nozzle 6*b*, and third nozzle 6*c* from the top in FIGS. 2A to 2C). The droplets 8 having been dispensed at this time were of a substantially complete round and diameters thereof were about 100 μm. The source solution of droplet was of an aqueous solution type, specifically an aqueous solution of palladium acetate-ethanolamine complex. The ink jet head 6 was of the bubble jet method for generating a bubble in the solution by use of thermal energy and discharging the solution, based on generation of the bubble.

The aqueous solution of palladium acetate-ethanolamine complex was an aqueous solution having the composition of 0.05 wt % polyvinyl alcohol, 15 wt % 2-propanol, 1 wt % ethylene glycol, and 0.15 wt % palladium acetate-ethanolamine complex ($Pd(NNH_2CH_2CH_2OH)_4(CH_3COO)_2$) based on the palladium concentration by weight, dissolved in water.

Dispensing of droplets to the element sections of the substrate was carried out specifically as follows. The droplet dispensing device 6 was positioned in the direction of arrangement of the nozzles at the same intervals as those of the elements on the substrate as shown in FIG. 2A, and the head was first driven in the row direction (in the X-direction) to dispense a single droplet for each element in the first row through the third nozzle. Then the device was stepped by 500 μm in the column direction and thereafter the head was driven in the row direction to dispense a droplet for each element in the second row through the third nozzle and each element in the first row through the second nozzle (FIG. 2B). The device was further stepped by 500 μm in the column direction and thereafter the head was driven in the row direction to dispense a droplet for each element in the third row through the third nozzle, each element in the second row through the second nozzle, and each element in the first row through the first nozzle (FIG. 2C). After that, the droplets were dispensed to the elements in three rows through the three nozzles by one driving in the row direction and this step was repeated until totally three droplets each through the respective nozzles have been dispensed to each of the all elements in the plane. The driving for the final three rows was carried out as follows; the last driving in the row direction was carried out to dispense a droplet for each element only in one row of the 500th row through only the first nozzle; the second driving from the last in the row direction was carried out to simultaneously dispense droplets for the two rows of the 499th row and the 500th row through the first nozzle and through the second nozzle, respectively; the third driving from the last in the row direction was carried out to simultaneously dispense droplets for the three rows of the 498th row, the 499throw, and the 500throw through the first nozzle, through the second nozzle, and through the third nozzle, respectively.

At the start and at the end, the three nozzles can also be arranged so that the all nozzles always dispense the droplets; in that case, the droplets are also dispensed to the other areas than the elements at the start and at the end. Therefore, the substrate pattern is preferably one posing no problem with the droplets dispensed to the other areas than the element area.

After that, the substrate was baked at 350° C. for 20 minutes to remove the organic components, whereby the conductive thin film 4 made of fine particles of palladium oxide (PdO) was formed between the pair of element electrodes. Resistances of portions of the conductive thin film 4 were measured. The average of the resistances of the 75000 portions of the conductive thin film in the plane was 3.2 kΩ and the coefficient of variation (standard deviation/average) σ/R was 5.2%. For comparison, in the case where three droplets were dispensed to each element through a certain nozzle out of the three nozzles, 25000 portions of conductive thin film produced by the first nozzle showed the average of element 3.1 kΩ and σ/R 5.3%; 25000 portions of conductive thin film produced by the third nozzle showed the average of element 3.2 kΩ and σ/R 5.2%; 75000 portions of conductive thin film in the plane showed the average 3.2 kΩ and σ/R 8.4%. The dispersion was smaller by the method for dispensing the droplets to each element through the plural nozzles as in the present example.

Since the device according to the present example can dispense the droplets to the elements in three rows by one driving in the row direction, the droplets can be dispensed in the time equal to approximately one third of that in the case where the device is driven in the row direction by the three times the number of elements with one nozzle. Since the droplets are successively dispensed to each element through the plural nozzles, the variation in delivery amounts between the elements can be suppressed without fine adjustment of delivery amounts for each of the nozzles.

In the present example the source liquid for droplet was the aqueous-solution-based liquid, specifically the aqueous solution of palladium acetate-ethanolamine complex, and the droplet dispensing device 6 was the ink jet head of the bubble jet method for generating the bubble in the solution by use of thermal energy and discharging the liquid, based on the generation of bubble, but, without having to be limited to this example, the source liquid can be one containing another complex, selected from those described previously or may be a solution of organic solvent, and the liquid dispensing device may be a head using the piezoelectric device. In the present example the head side was driven to move the head relative to the substrate, but the head side can be fixed while the substrate side is driven to effect dispensing; or it is also similarly possible to dispense the droplets by using a droplet dispensing device having nozzles arranged at the pitch of 700 μm equal to the element intervals in the row direction and driving the device in the column direction.

Figure 17:
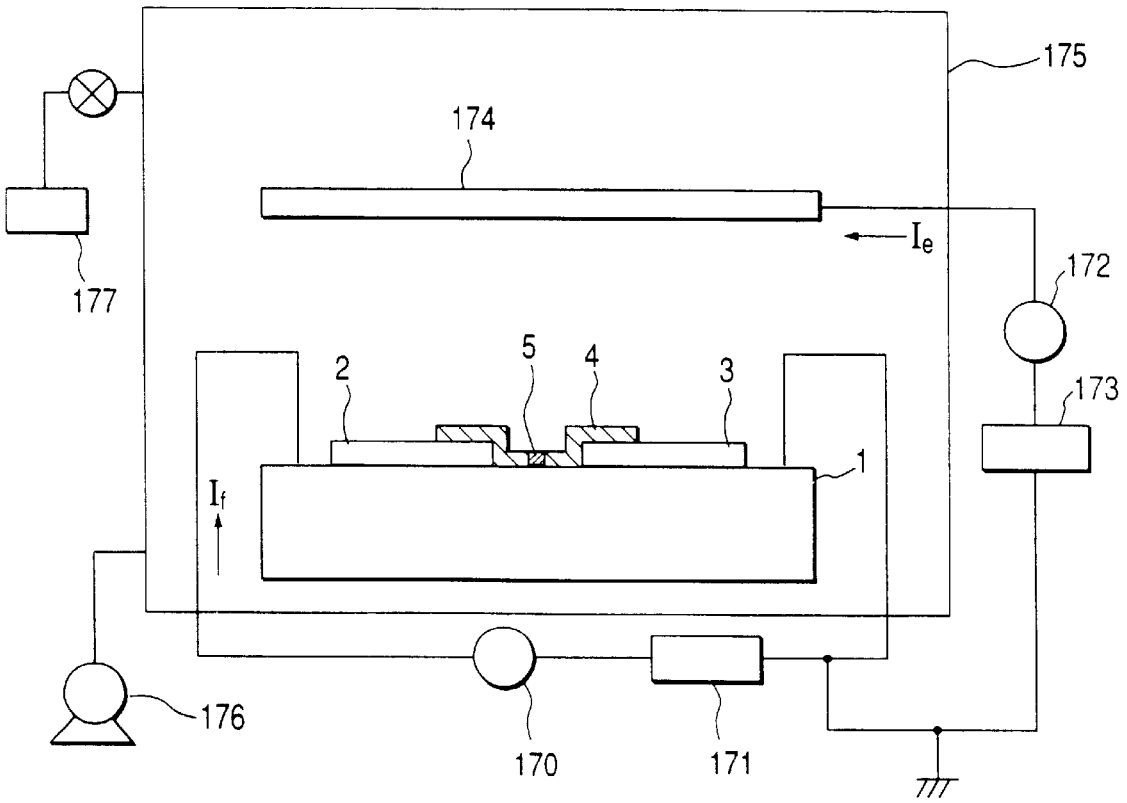
FIG. 17 shows a vacuum processing apparatus for use in the first embodiment.

Next, the substrate on which a conductive film 4 of the present embodiment is formed is provided within a vacuum processing apparatus shown in FIG. 17. And, the apparatus is evacuated into $10^{-8}$ Torr by a vacuum pump.

With regard to the vacuum processing apparatus shown in FIG. 17, an explanation is made as follow. FIG. 17 shows schematicallly an example of the vacuum processing apparatus. The vacuum processing apparatus can perform a forming processing, an activation processing and a stabilizing processing. Also, in FIG. 17, the same portions as in FIGS. 5A and 5B are denoted by the same reference numerals as in FIGS. 5A and 5B. Referring to FIG. 17, 175 denotes a vacuum container, and 176 an exhaust pump. Within the vacuum container 175, the electron emission elements are arranged. That is, 1 denotes a substrate constituting the electron emission elements, 2 and 3 element electrodes, 4 a conductive this film, and 5 an electron emitting section. 171 denotes a power source for applying an element voltage $V_f$ to the electron emission elements, 170 a current meter for measuring an element current $I_f$ flowing through the conductive thin film 4 between the element electrodes 2 and 3, 174 an anode electrode for trapping emission current $I_e$ emitted from the electron emitting sections of the elements, 173 a high voltage power source for applying a voltage to the anode electrode 174, 172 a current meter for measuring the emission current $I_e$ emitted from the electron emitting section 5, and 177 a source for producing an organic gas for use in the activation process. The exhaust pump 176 comprises a super high vacuum apparatus system comprising a turbo pump, a dry pump, an ion pump etc. Whole of the vacuum processing apparatus in which the electron source substrate is arranged can be heated into 350° C. by a heater not shown in the drawings.

Within the vacuum processing apparatus shown in FIG. 17 described in the above, the forming processing is performed. Electrically energization for conducting between the element electrodes 2 and 3 at a section of the conductive thin film 4, a fissure is formed. A voltage waveform of the energization forming is a pulse waveform. The voltage pulse waveform of step shape is raising from 0 volt to 0.1 volt is applied. A width and an interval of the voltage pulse are respectively 1 msec and 10 msec. The energization forming processing is terminated when the conductive thin film has a resistance 1MΩ or more.

Figure 18:
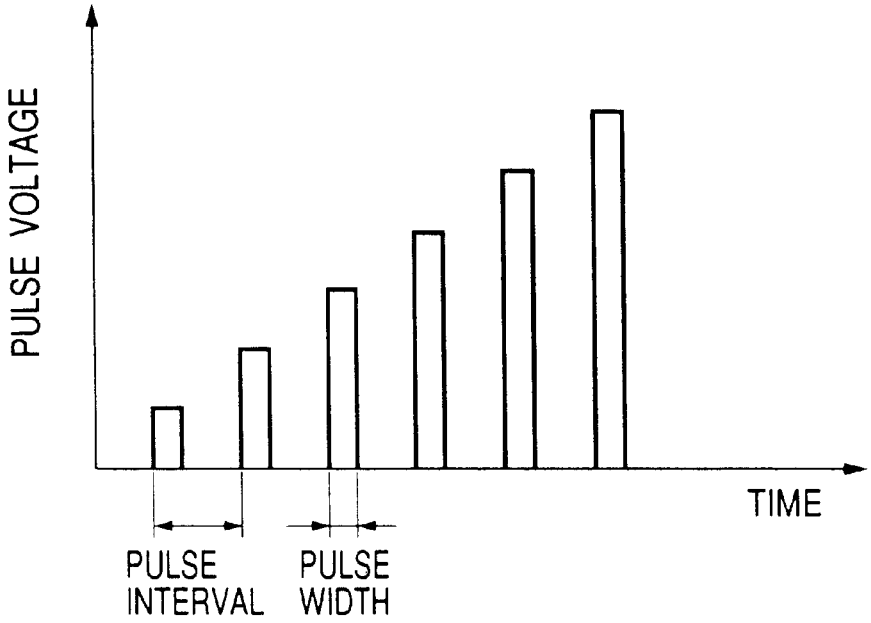
FIG. 18 shows on energization forming wave form for use in the first embodiment.

FIG. 18 shows the forming waveform used in the present embodiment. One of the element electrodes 2 and 3 is set at a lower voltage, while the other is set at a higher voltage.

The element after the forming processing is subjected to the activation processing. The activation processing forms a carbon or a carbon compound, and changes the element current $I_f$ and the emission current Ie significantly.

In the activation processing, an acetone gas is introduced into the vacuum processing container in FIG. 17 by $10^{-3}$ Torr, and a bipolar pulse of a square waveform with a pulse height 15V, pulse width 1 msec and pulse interval 10 msec is applied for 20 minutes.

Figure 19:
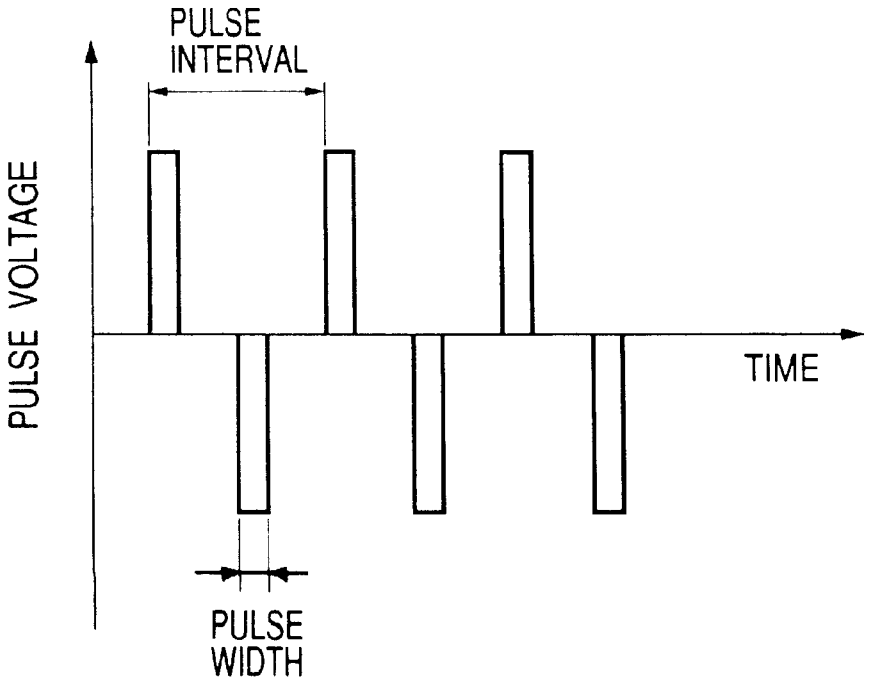
FIG. 19 shows a pulse wave form used in an activation processing in the first embodiment.

FIG. 19 shows a pulse waveform used in the activation process. According to the present embodiment, the element electrodes 2 and 3 are supplied with alternatingly low and high voltages in pulse interval.

And then, the stabilizing process is performed. In the stabilizing process, the organic gas in the atmosphere within the vacuum container is exhausted. A newly depositing of the carbon and the carbon compound or the electron emitting portion is limited. And, the element current $I_f$ and the emitting current $I_e$ are stabilized. The vacuum container is heated wholly at 250° C., and the organic molecule absorbed at an inner wall of the vacuum container and the electron emission elements is exhausted.

Thus, the electron emitting source substrate provided with the surface conduction type electron emission elements group is completed.

When the plural droplets were dispensed to each element by the method described in Example 1 above, the dispensing time was able to be decreased, the variation in dispensing amounts was able to be suppressed in low level, and the electron source substrate was able to be constructed of the surface conduction type electron emitting elements with the electron emission characteristics equivalent to those of the conventional elements.

According to the present invention, since plural times of liquid droplets are dispensed to a single section when, after dispensing thereto the droplet, a time interval before the next droplet dispensing is too short, a spreading expansion of the droplet at the section would likely exceed a tolerable range. Accordingly, a minimum interval of droplet dispensing is to be determined based on the tolerability. More desirably, the droplet is dried sufficiently by the next droplet dispensing. Such droplet dispensing interval may be about 2 seconds or more.

Example 2

Using the electron source substrate before the forming processing produced by the production method of Example 1, the enclosure was constructed of the face plate 86, the support frame 82, and the rear plate 81 as shown in FIG. 10. Thereafter, an inside is exhaust into vacuum. Similar to the first embodiment, it is subjected to forming, activation and stabilization processing. And, then it is sealed in vacuum. Thereafter, the image forming apparatus was produced by providing it with the driving circuit for TV display based on the television signals of the NTSC method as shown in FIG. 12.

Dispersion in luminance of the image forming apparatus produced in this example was measured and it was 5.7% (standard deviation of luminance/average of luminance) in 75000 pixels. On the other hand, dispersion in luminance of the image forming apparatus, which was produced using the electron source substrate made by dispensing three droplets to each element on the substrate through one nozzle out of the three nozzles as discussed as comparison in Example 1, was 9.2%, and thus the dispersion in luminance was lower with the apparatus of this example of the present invention.

The image forming apparatus with low dispersion in luminance was made in a short time by the method described in the present example.

The invention disclosed in the present application can suppress the dispersion in dispensing amounts of material on the occasion of dispensing the material through a plurality of output sections. In addition, the time for dispensing the material can also be decreased as compared with the dispensing method for dispensing the material through a single output section. Therefore, the throughput and quality can be improved in production of the electron source having the electron emitting portions. The invention can also realize reduction in cost.

What is claimed is:

1. A method for producing an electron source that includes a plurality of electron emitting portions, said method comprising the step of:

by use of a plurality of output portions for respectively outputting a substantially homogeneous material for formation of the plurality of electron emitting portions, performing at least one dispensing operation of the material by each of the plurality of output portions to one of a plurality of objective portions to which the material for formation of the plurality of electron emitting portions is to be dispensed.

2. The method for producing an electron source according to claim 1, wherein each of the plurality of objective portions is subjected to an identical combination of dispensing operations of the material from the plurality of output portions.

3. The method for producing an electron source according to claim 1, wherein dispensing operations of the material from different ones of the plurality of output portions are carried out substantially simultaneously to different ones of the plurality of objective portions.

4. The method for producing an electron source according to claim 1, wherein dispensing operations of the material are carried out while moving the plurality of output portions relative to the plurality of objective portions.

5. A method for producing an electron source that includes a plurality of electron emitting portions arranged in a column, the plurality of electron emitting portions being formed by dispensing a material to objective portions arranged in a column, said method comprising the step of:

with moving a material dispensing device that includes a plurality of output portions arranged in a column direction in correspondence to intervals of the objective portions arranged in the column direction, relative to the objective portions arranged in the column direction, performing dispensing operations of a substantially homogeneous material by each of the plurality of output portions to one of the objective portions.

6. The method for producing an electron source according to claim 5, wherein the electron source includes a plurality of electron emitting portions arranged in a row and column pattern, a row direction not being parallel to the column direction, and the dispensing operations of the material to the respective objective portions are carried out while moving the material dispensing device relative to the objective portions in the row direction.

7. The method for producing an electron source according to claim 6, wherein every time relative positions of the material dispensing device and the objective portions are changed in the column direction, dispensing operations of the material are carried out by successively and relatively moving the material dispensing device in the row direction, thereby performing the dispensing operations of the material to the respective objective portions arranged in the row direction.

8. The method for producing an electron source according to claim 5, wherein a number of dispensing operations of the material to one objective portion is not less than a number of the plurality of output portions.

9. The method for producing an electron source according to any one of claims 1 to 8, wherein the dispensing operations of the material is carried out in a liquid state of the material.

10. The method for producing an electron source according to claim 9, wherein the dispensing operations of the material is carried out by an ink jet method.

11. The method for producing an electron source according to any one of claims 1 to 8, wherein the dispensing operations of the material is carried out by a method for generating a bubble in the material by use of thermal energy and discharging the material, based on generation of the bubble.

12. The method for producing an electron source according to any one of claims 1 to 8, wherein the dispensing operations of the material is carried out by discharging the material using a piezoelectric device.

13. The method for producing an electron source according to any one of claims 1 to 8, wherein each of the plurality of electron emitting portions is formed between element electrodes.

14. The method for producing an electron source according to any one of claims 1 to 8, further comprising the step of forming the plurality of electron emitting portions by electrification of the material deposited on the plurality of objective portions.

15. The method for producing an electron source according to any one of claims 1 to 8, wherein the material is comprised of an electrically conductive material.

16. An electron source produced by the method for producing an electron source as set forth in any one of claims 1 to 8.

17. A method for producing an image forming apparatus, said method comprising the step of placing a member for forming an image with electrons emitted from the plurality of electron emitting portions of the electron source, as set forth in claim 16, opposite the electron source.

18. An image forming apparatus produced by the method for producing an image forming apparatus as set forth in claim 17.

* * * * *

UNITED STATES PATENT AND TRADEMARK OFFICE

CERTIFICATE OF CORRECTION

PATENT NO. : 6,220,912 B1
DATED : April 24, 2001
INVENTOR(S) : Kazuya Shigeoka et al.

It is certified that error appears in the above-identified patent and that said Letters Patent is hereby corrected as shown below:

Title page,
Item [30], FOREIGN PATENT DOCUMENTS, insert -- May 7, 1998 (JP) ……...10-139240 --.

Item [56], References Cited, OTHER PUBLICATIONS, after "C.A. Spindt, et al.," Physical," should read -- Physics, --.

Column 1,
Lines 1 and 49, "of" should read -- of an --; and
Line 65, "do" should read -- dc --; and "to the" should read -- to --.

Column 2,
Line 21, "Applicant." should read -- the applicants --; and
Line 49, "14C." should read -- 14C, --.

Column 3,
Line 63, "such" should read -- such a --.

Column 4,
Line 5, "row" should read -- to the row --;
Line 7, "such" should read -- such a --;
Line 59, "such" should read -- such a --.

Column 5,
Line 1, "of" should read -- of an --;
Line 18, "such" should read -- such a --.

Column 7,
Line 18, "length 1" should read -- length 1 --; and
Line 65, "Ifn" should read -- In --.

Column 8,
Line 25, "Jet" should read -- jet --.

UNITED STATES PATENT AND TRADEMARK OFFICE

CERTIFICATE OF CORRECTION

PATENT NO. : 6,220,912 B1
DATED : April 24, 2001
INVENTOR(S) : Kazuya Shigeoka et al.

It is certified that error appears in the above-identified patent and that said Letters Patent is hereby corrected as shown below:

Column 9,
Line 13, “the all” should read -- all the --;
Line 16, “film” should read -- films --;
Line 21, “not” should read -- (not --;
Line 22, “illustrated” should read -- illustrated) --;
Line 30, “pulses;” should read -- pulses: --; and
Line 32, “FIG. 8A;” should read -- FIG. 8A; and --.

Column 10,
Line 30, “the” should be deleted;
Line 43, “10-7 Torr” should read -- $10^{-7}$ Torr --; and
Line 47, “element.” should read -- the element. --.

Column 11,
Line 46, “not illustrated” should read -- (not illustrated) --; and
Line 50, “not illustrated” should read -- (not illustrated) --.

Column 12,
Line 56, “sufficient” should read -- a sufficient --; and
Line 60, “sufficient” should read -- a sufficient --.

Column 13,
Line 5, “quiet” should read -- subdue a --; and

Column 14,
Line 22, “do” should read -- dc --;
Line 51, “nience’ sake” should read -- nience --; and
Line 53, “convenience’ sake.” should read -- convenience. --.

Column 17,
Line 1, “EXAMPLE” should read -- EXAMPLES --.

UNITED STATES PATENT AND TRADEMARK OFFICE

CERTIFICATE OF CORRECTION

PATENT NO. : 6,220,912 B1
DATED : April 24, 2001
INVENTOR(S) : Kazuya Shigeoka et al.

It is certified that error appears in the above-identified patent and that said Letters Patent is hereby corrected as shown below:

Column 18,
Line 1, “the all” should read -- all the --;
Line 3, “follows;” should read -- follows: --;
Line 6, “last” should read -- last driving --;
Line 9, “last” should read -- last driving --;
Line 11, “499throw,” should read -- 499th row, --;
Line 12, “500throw” should read -- 500th row --;
Line 15, “the all” should read -- all the --;
Line 50, “droplet,” should read -- droplets --; and
Line 57, “bubble,” should read -- bubbles, --.

Column 19,
Line 8, “follow.” should read -- follows. --; and
Line 53, “Ie” should read -- $I_e$ --.

Signed and Sealed this

Eighteenth Day of June, 2002

*Attest:*

*Attesting Officer*

JAMES E. ROGAN
*Director of the United States Patent and Trademark Office*